US008827733B2

(12) United States Patent
Yoshida et al.

(10) Patent No.: US 8,827,733 B2
(45) Date of Patent: Sep. 9, 2014

(54) CONNECTING TERMINAL WITH A FIXED PORTION AND A CONTACT

(75) Inventors: Hitoshi Yoshida, Otsu (JP); Hidekazu Yoshioka, Yawata (JP); Takaaki Suzumura, Ritto (JP); Yoshinobu Yamazaki, Otsu (JP); Takanobu Nagata, Hikone (JP)

(73) Assignee: OMRON Corporation, Kyoto (JP)

( * ) Notice: Subject to any disclaimer, the term of this patent is extended or adjusted under 35 U.S.C. 154(b) by 126 days.

(21) Appl. No.: 13/258,223

(22) PCT Filed: Mar. 24, 2011

(86) PCT No.: PCT/JP2011/057197

§ 371 (c)(1),
(2), (4) Date: Feb. 3, 2012

(87) PCT Pub. No.: WO2012/124171

PCT Pub. Date: Sep. 20, 2012

(65) Prior Publication Data

US 2012/0238118 A1 Sep. 20, 2012

(30) Foreign Application Priority Data

Mar. 15, 2011 (JP) ..... 2011-057074

(51) Int. Cl.

| | |
|---|---|
| ***H01R 11/22*** | (2006.01) |
| ***H01R 12/88*** | (2011.01) |
| ***H01R 12/79*** | (2011.01) |
| ***C25D 1/00*** | (2006.01) |
| ***H01R 12/57*** | (2011.01) |

(52) U.S. Cl.

CPC ..... *H01R 12/57* (2013.01); *H01R 12/88* (2013.01); *H01R 12/79* (2013.01); *C25D 1/003* (2013.01)

USPC ..... 439/267

(58) Field of Classification Search

CPC ..... H01R 23/6833; H01R 23/684; H01R 23/6848; H01R 23/7068; H01R 13/193

USPC ..... 439/267, 850–860, 876

See application file for complete search history.

(56) References Cited

U.S. PATENT DOCUMENTS 2,938,068 A * 5/1960 Silverschotz ..... 174/84 R
3,158,425 A * 11/1964 Pritulsky ..... 439/853

(Continued)

FOREIGN PATENT DOCUMENTS

JP 10-270140 A 10/1998
JP 2003-249292 A 9/2003

(Continued)

OTHER PUBLICATIONS

International Search Report from PCT/JP2011/057197 dated Apr. 26, 2011 (4 pages).

(Continued)

*Primary Examiner* — Amy Cohen Johnson
*Assistant Examiner* — Vladimir Imas
(74) *Attorney, Agent, or Firm* — Osha Liang LLP

(57) ABSTRACT

A connecting terminal for a connector has a fixed portion configured to be connected to an electrode portion provided in a member for mounting the connector, and a contact configured to electrically come in contact with a contact portion of a connected portion to be connected to the connector. At least one concave portion is provided along a whole outer peripheral surface of the connector terminal.

9 Claims, 35 Drawing Sheets

(56) References Cited

U.S. PATENT DOCUMENTS

| | | | | | |
|---|---|---|---|---|---|
| 4,066,326 | A * | 1/1978 | Lovendusky | 439/873 |
| 4,080,037 | A * | 3/1978 | Kunkle et al. | 439/853 |
| 4,245,876 | A * | 1/1981 | Ritchie et al. | 439/590 |
| 4,410,230 | A * | 10/1983 | SanMiguel | 439/682 |
| 4,469,394 | A * | 9/1984 | Verhoeven | 439/873 |
| 4,577,922 | A * | 3/1986 | Stipanuk et al. | 439/629 |
| 4,597,628 | A * | 7/1986 | Seidler | 439/876 |
| 4,695,106 | A * | 9/1987 | Feldman et al. | 439/83 |
| 4,750,889 | A * | 6/1988 | Ignasiak et al. | 439/83 |
| 4,780,087 | A * | 10/1988 | Berg et al. | 439/62 |
| 4,780,093 | A * | 10/1988 | Walse et al. | 439/418 |
| 4,998,886 | A * | 3/1991 | Werner | 439/66 |
| 5,169,321 | A * | 12/1992 | Matsuoka | 439/71 |
| 6,113,412 | A * | 9/2000 | Lin | 439/342 |
| 6,261,136 | B1 * | 7/2001 | Dennis | 439/876 |
| 6,338,630 | B1 * | 1/2002 | Dong | 439/74 |
| 6,679,709 | B2 * | 1/2004 | Takeuchi | 439/83 |
| 6,824,414 | B2 * | 11/2004 | Whyne et al. | 439/342 |
| 7,052,289 | B1 * | 5/2006 | Hao | 439/83 |
| 7,168,990 | B2 * | 1/2007 | Suzuki et al. | 439/636 |
| 7,178,232 | B2 * | 2/2007 | Mongold et al. | 29/843 |
| 7,196,907 | B2 * | 3/2007 | Zheng | 361/760 |
| 7,255,576 | B2 * | 8/2007 | O'Sullivan et al. | 439/72 |
| 7,419,407 | B1 * | 9/2008 | Jolly et al. | 439/714 |
| 7,549,897 | B2 * | 6/2009 | Fedder et al. | 439/751 |
| 7,621,784 | B2 * | 11/2009 | Ichimiya et al. | 439/676 |
| 7,695,329 | B2 * | 4/2010 | Peloza et al. | 439/876 |
| 7,753,742 | B2 * | 7/2010 | Fedder et al. | 439/751 |
| 7,837,522 | B1 * | 11/2010 | Hoover et al. | 439/876 |
| 7,905,739 | B2 * | 3/2011 | Hemmi et al. | 439/260 |
| 7,927,109 | B1 * | 4/2011 | Gattuso | 439/66 |
| 7,938,696 | B2 * | 5/2011 | Genau et al. | 439/857 |
| 7,967,628 | B2 * | 6/2011 | Zhang | 439/342 |
| 8,002,594 | B2 * | 8/2011 | Cheng | 439/862 |
| 8,033,870 | B2 * | 10/2011 | Xie | 439/660 |
| 8,038,467 | B2 * | 10/2011 | Shen et al. | 439/495 |
| 8,047,874 | B2 * | 11/2011 | Ito | 439/607.1 |
| 8,062,055 | B2 * | 11/2011 | Myer et al. | 439/366 |
| 8,123,574 | B2 * | 2/2012 | Ma | 439/862 |
| 2007/0044404 | A1 * | 3/2007 | Shimada et al. | 52/309.7 |
| 2010/0081299 | A1 * | 4/2010 | Hemmi et al. | 439/67 |
| 2010/0081336 | A1 * | 4/2010 | Hemmi et al. | 439/658 |
| 2012/0238118 | A1 * | 9/2012 | Yoshida et al. | 439/259 |
| 2013/0045617 | A1 * | 2/2013 | Yoshida et al. | 439/345 |

FOREIGN PATENT DOCUMENTS

| | | | |
|---|---|---|---|
| JP | 2004-61390 | A | 2/2004 |
| JP | 2009-208106 | A | 9/2009 |
| JP | 2010-86878 | A | 4/2010 |

OTHER PUBLICATIONS

Written Opinion from PCT/JP2011/057197 dated Apr. 26, 2011 (4 pages).

* cited by examiner

Fig. 2 (A) PRIOR ART
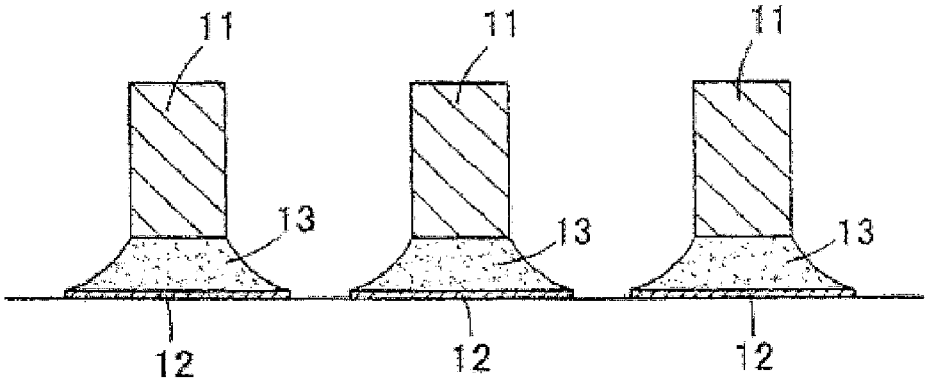
Fig. 2 (B) PRIOR ART
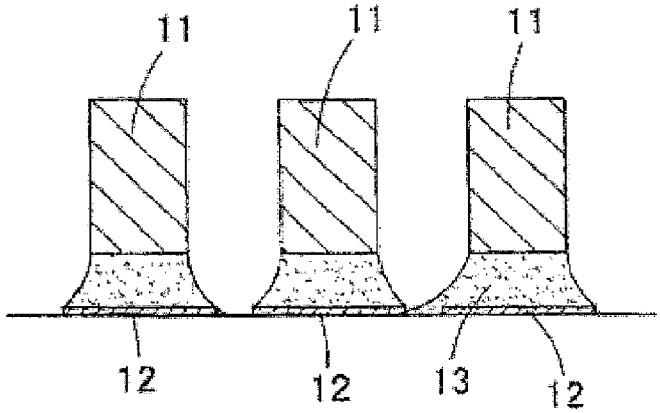

11
H1
W1

31
40
H1
a
a
b
b
W1

31
40
H2
a
a
b
b
W1

CONNECTING TERMINAL WITH A FIXED PORTION AND A CONTACT

TECHNICAL FIELD

The present invention relates to a connecting terminal for a connector and a method of manufacturing the terminal, and more particularly to a connecting terminal for a connector which is to be used for the connector to connect a flexible printed circuit board, and a method of manufacturing the same.

BACKGROUND ART

Some of various electronic apparatuses use a connector for inserting and connecting a flexible printed circuit board. For example, the connector is mounted on a surface of a circuit board and the flexible printed circuit board is inserted and connected to the connector. Consequently, the circuit board and the flexible printed circuit board are connected to each other through the connector. Such a connector is disclosed in Patent Document 1, for example.

Referring to a connector for connecting a flexible printed circuit board, a connecting terminal 11 for a connector shown in FIG. 1 is inserted into a terminal inserting hole provided in a housing thereof, and a plurality of connecting terminals 11 for a connector is arranged at a certain pitch. The connecting terminal 11 for a connector has such a shape that a fixed piece 14 and a movable piece 15 which are disposed in almost parallel with each other are coupled to each other through a coupling portion 16 which is almost perpendicular to both of the pieces 14 and 15. A lower surface of a tip portion of the fixed piece 14 is exposed from a bottom face of the housing. When the connector is to be mounted on the circuit board, the lower surface of the tip portion of the fixed piece 14 is bonded to an electrode pad 12 of the circuit board through a solder as shown in FIG. 2(A). A movable contact 17 is provided on the lower surface of the tip portion of the movable piece 15, and a rear end of the movable piece 15 serves as an operation receiving portion 18 for tilting the movable piece 15 like a lever by means of a cam portion.

In a flexible printed circuit board 19, as shown in FIG. 3, a lead wire 21 is formed on a surface of a resin sheet 20 and a wide contact portion 22 is provided on a tip of the wiring lead wire 21 to be connected to the connecting terminal 11 for a connector.

An end of the flexible printed circuit board 19 is inserted between the movable piece 15 and the fixed piece 14 in the connecting terminal 11 for a connector which are arranged in a line, and each contact portion 22 of the flexible printed circuit board 19 is aligned with each movable contact 17. As shown in FIG. 4, when the operation receiving portion 18 of the connecting terminal 11 for a connector is pushed up by means of the cam portion in that state, the movable piece 15 is tilted so that the movable contact 17 is moved downward and the movable contact 17 comes in pressure contact with the contact portion 22, and furthermore, the flexible printed circuit board 19 is caused to mate into a portion between the movable contact 17 and the fixed piece 14 to connect the flexible printed circuit board 19 to the connector.

When the number of the terminals of the connector is increased, however, an array pitch of the connecting terminal 11 for the connector is shortened. When a refining technique for the flexible printed circuit board progresses, moreover, the array pitch of the contact portion 22 can be shortened more greatly. More specifically, in case of the flexible printed circuit board 19 fabricated by a subtractive process, minimum pattern dimensions Wa and Wb shown in FIG. 3 are 50 μm, a minimum space dimension Sa is also 50 μm, and a tolerance is ±20 μm. In a minimum pitch design, moreover, a width Wc of the contact portion 22 is 100 μm and a space Sb between the contact portions 22 is 100 μm. In consideration of the tolerance of ±20 μm, a width has a variation within a range of 80 μm to 120 μm in the contact portion 22 of the width Wc=100 μm. In order to reliably cause the connecting terminal 11 for the connector to come in contact with the contact portion 22, accordingly, it is necessary to set the width of the connecting terminal 11 for the connector to be equal to or smaller than 80 μm.

In the case in which the connecting terminal 11 for the connector which has a small width is used, thus, the array pitch of the connecting terminal 11 for the connector is also reduced correspondingly. In the case in which the connecting terminal 11 for the connector is soldered to the electrode pad 12, however, a spread of the solder 13 in the electrode pad 12 (the circuit board) is greater than the width of the connecting terminal 11 for the connector. For this reason, in the case in which the connecting terminal 11 for the connector is arranged in a small array pitch, there is a fear that the solder 12 might spread over the adjacent electrode pad 12 to short-circuit the connecting terminals 11 for the connector as shown in FIG. 2B. In particular, a positional shift of the connecting terminal 11 for the connector or an excessive amount of supply of a solder increases the fear that the connecting terminals 11 for the connector might be short-circuited.

In order to reduce the spread of the solder 13, thereby preventing the short circuit between the connecting terminals 11 for the connector which are adjacent to each other, it is effective to decrease the width of the connecting terminal 11 for the connector. In order to raise a contact pressure at which the movable contact 17 of the connecting terminal 11 for the connector comes in contact with the contact portion 22, moreover, it is effective to decrease the width of the connecting terminal 11 for the connector, thereby reducing an area of the movable contact 17.

However, a spring property or a rigidity of the connecting terminal 11 for the connector is deteriorated when the width of the connecting terminal 11 for the connector is decreased. To the contrary, there is caused a drawback that the contact pressure of the connecting terminal 11 for the connector and the contact portion 22 is reduced or a force for holding the flexible printed circuit board 19 by the connecting terminal 11 for the connector is reduced.

PATENT DOCUMENT

Patent Document 1: Japanese Unexamined Patent Publication No.

SUMMARY OF THE INVENTION

One or more embodiments of the present invention provides a connecting terminal for a connector which can reduce a spread of a solder for connecting the connecting terminal for a connector to an electrode portion and raising a contact pressure of a movable contact of the connecting terminal for a connector with a rare reduction in a contact pressure or a holding force of a connected portion such as a flexible printed circuit board through the connecting terminal for a connector. Furthermore, one or more embodiments of the present invention provides a method of manufacturing a connecting terminal for a connector which can easily manufacture the connecting terminal for a connector.

A connecting terminal for a connector according to one or more embodiments of the present invention includes a fixed portion to be connected to an electrode portion provided in a member for mounting the connector and a contact caused to electrically come in contact with a contact portion of a connected portion to be connected to the connector, wherein at least one circular concave portion is provided along a whole outer peripheral surface.

In the connecting terminal for a connector according to one or more embodiments of the present invention, in the case in which the concave portion passes through the fixed portion for connecting an electrode portion, it is possible to reduce a spread of a conductive bonding material such as a solder in the electrode portion and to prevent a short circuit between the electrode portions due to the bonding material or a short circuit between the connecting terminals for a connector.

In the case in which the concave portion is provided along at least one of edges in both side edges of the outer peripheral surface of the connecting terminal for a connector, particularly, the spread of the bonding material in the fixed portion is reduced. Therefore, the spread of the bonding material on the electrode portion side is also reduced.

According to the connecting terminal for a connector in accordance with one or more embodiments of the present invention, therefore, a short circuit occurs with difficulty. Therefore, it is possible to reduce a width or pitch of the electrode portion. As a result, it is also possible to reduce an array pitch of the connecting terminal.

Referring to the connecting terminal for a connector according to one or more embodiments of the present invention, moreover, a contact area of the contact can be decreased by the concave portion in the case in which the concave portion passes through the contact for coming in contact with the contact portion of the connected portion. Therefore, it is possible to raise a contact pressure of the contact.

In the connecting terminal for a connector according to one or more embodiments of the present invention, in the case in which a region protruded from the concave portion of the outer peripheral surface is divided into a plurality of regions through the concave portion, the contact is also divided into a plurality of regions and thus comes in contact with the contact portion in a plurality of places. Even in the case in which a fine current flows to the connecting terminal for a connector, therefore, it is possible to enhance a contact reliability of the contact.

In the connecting terminal for a connector according to one or more embodiments of the present invention, furthermore, the concave portion is provided in only the outer peripheral surface of the connecting terminal. As compared with the case in which the width of the connecting terminal for a connector is to be reduced, therefore, a spring property of the connecting terminal is deteriorated with more difficulty. Accordingly, it is also possible to decrease a reduction in a contact pressure of the contact. Moreover, there are also advantages that a weight of the connecting terminal can be decreased, a cost of materials can be reduced and a total cost can be thus cut down.

The connector according to one or more embodiments of the present invention is characterized in that a plurality of connecting terminals for a connector according to one or more embodiments of the present invention is incorporated into a base and the connecting terminal for the connector is operated by means of an operation lever. According to the connector, it is possible to reduce a pitch of the connecting terminal. Therefore, it is possible to achieve a multipolarization and a reduction in a size.

A first method of manufacturing a connecting terminal for a connector according to one or more embodiments of the present invention includes a first step of forming a resist film on a surface of an electrode plate, a second step of forming a molding opening on the resist film, and a third step of depositing an electroforming material in the molding opening by an electroforming process, the first to third steps being repeated in a plurality of cycles to form a molding opening having a different size in at least one layer in the resist films to be respective layers and to mold a connecting terminal for a connector by an electroforming material in the molding opening.

In the first manufacturing method, the size of the molding opening in each resist film is varied. Therefore, a concave portion is formed on an electroforming material, that is, an outer peripheral surface of the connecting terminal in a layer having a small molding opening. Moreover, it is sufficient that the resist film of each layer is caused to make the size of the opening different. Therefore, it is possible to easily fabricate connecting terminals having various shapes by an electroforming process.

A second method of manufacturing a connecting terminal for a connector according to one or more embodiments of the present invention includes the steps of forming a resist film on a surface of an electrode plate, forming a molding opening on the resist film, depositing an electroforming material having a plurality of layers in the molding opening through an electroforming process by using a plurality of types of electroforming materials, at least a part of which has a different etching characteristic from the other electroforming materials, and removing the resist film and then etching an outer peripheral surface of a part of the electroforming material layers by utilizing the difference in the etching characteristic of the electroforming material having a plurality of layers.

In the second manufacturing method, the plurality of types of electroforming materials are laminated and molded and are then etched selectively. Therefore, a concave portion is formed on the electroforming material layer having a high etching rate. According to the method, a connecting terminal having no concave portion is manufactured by the electroforming process and is then etched selectively. Consequently, it is possible to easily form the concave portion.

A third method of manufacturing a connecting terminal for a connector according to one or more embodiments of the present invention includes the steps of forming, on a surface of an electrode plate, resist films to be a plurality of layers, at least a part of which has a different exposure sensitivity from the other resist films, forming a molding opening on the resist films to be the layers by a photolithography and increasing an opening width of the resist films of a part of the layers, and depositing an electroforming material in the molding opening by an electroforming process, thereby fabricating the connecting terminal.

In the third manufacturing method, when the molding opening is to be formed on the resist film having the layers by the photolithography, a size of the opening is reduced in a positive resist having a low exposure sensitivity or a negative resist having a high exposure sensitivity. Therefore, a concave portion is formed on the outer peripheral surface of the electroforming material in the layer place.

A fourth method of manufacturing a connecting terminal for a connector according to one or more embodiments of the present invention includes the steps of forming, on a surface of an electrode plate, resist films to be a plurality of layers, at least a part of which has a different reactivity to a developing solution from the other resist films, forming a molding opening on the resist films to be the layers by a photolithography and increasing an opening width of the resist films of a part of the layers, and depositing an electroforming material in the molding opening by an electroforming process, thereby fabricating the connecting terminal.

In the fourth manufacturing method, when the molding opening is to be formed on the resist film by the photolithography, the opening is reduced with a resist film having a low reactivity to a developing solution than a resist film having a high reactivity to the developing solution. Accordingly, a concave portion is formed on the outer peripheral surface of the connecting terminal in the place of the resist film having the low reactivity to the developing solution.

A fifth method of manufacturing a connecting terminal for a connector according to one or more embodiments of the present invention includes the steps of forming, on a surface of an electrode plate, resist films to be a plurality of layers, at least a part of which has a different etching characteristic from the other resist films, forming a molding opening on the resist films to be the layers by a photolithography, selectively etching an inner peripheral surface of the molding opening, thereby increasing an opening width of the resist films of a part of the layers, and depositing an electroforming material in the molding opening by an electroforming process, thereby fabricating the connecting terminal.

In the fifth manufacturing method, when the inner peripheral surface of the molding opening formed on the resist films to be the layers is selectively etched, the opening spreads over the layer of the resist film having a high etching rate and rarely spreads over the layer of the resist film having a low etching rate. Therefore, the concave portion is formed on the outer peripheral surface of the connecting terminal.

In the connecting terminal for a connector according to one or more embodiments of the present invention, moreover, one or more circular concave portion may be provided along a whole outer peripheral surface by using the first to fifth methods of manufacturing a connecting terminal for a connector according to one or more embodiments of the present invention.

BRIEF DESCRIPTION OF THE DRAWINGS

FIG. 2(A) is a schematic sectional view showing a state in which the connecting terminal for a connector is soldered to the electrode pad. FIG. 2(B) is a schematic sectional view showing a state in which a short circuit occurs between the connecting terminals for a connector due to a spread of a solder when a pitch of the connecting terminal for a connector is reduced.

DETAILED DESCRIPTION

Embodiments of the present invention will be described below with reference to the accompanying drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. The present invention is not restricted to the following embodiments but a design can variously be changed without departing from the gist of the present invention.

(Connecting Terminal for Connector According to First Embodiment)

Figure 5:
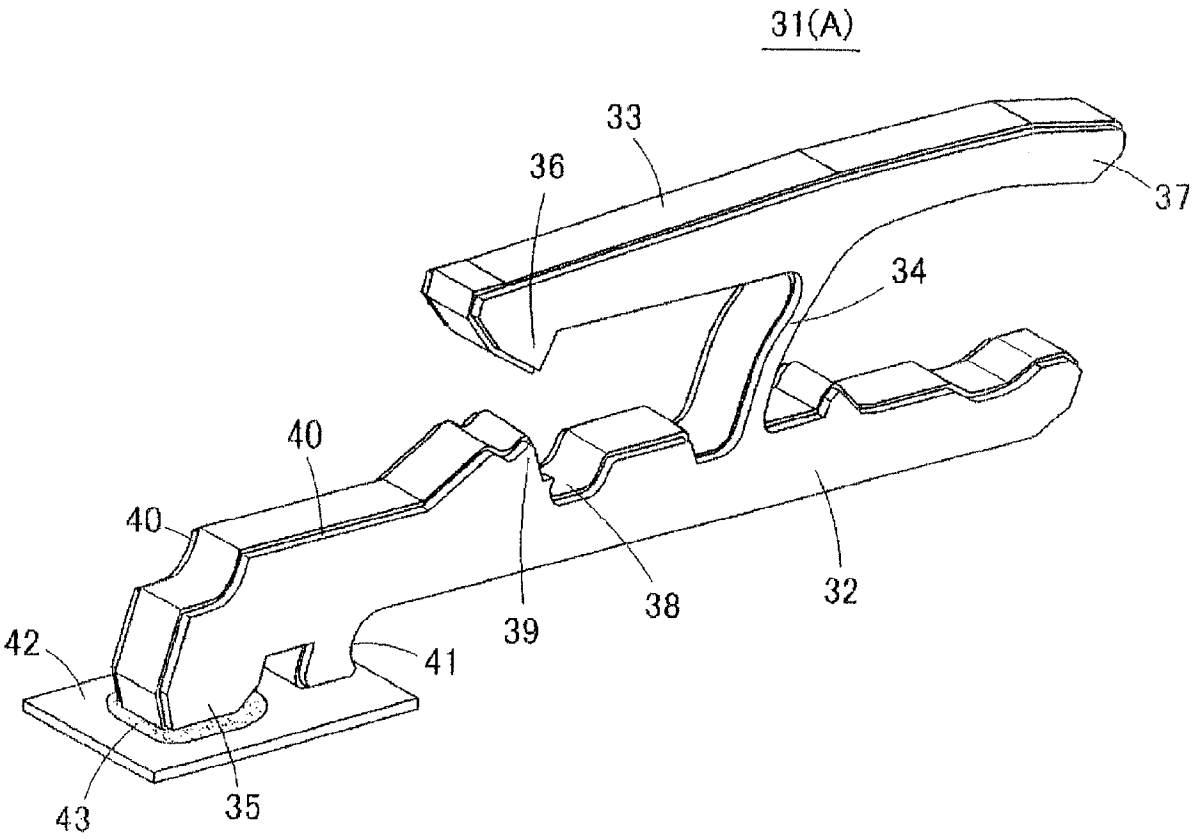
FIG. 5 is a perspective view showing a connecting terminal for a connector according to a first embodiment of the present invention.

FIG. 5 is a perspective view showing a connecting terminal for a connector according to a first embodiment of the present invention. A plurality of connecting terminals 31 for a connector is arranged and incorporated into a housing of a connector for connecting a flexible printed circuit board as will be described below.

The connecting terminal 31 takes such a shape that a fixed piece 32 and a movable piece 33 are disposed in almost parallel with each other and an upper surface of an almost central portion of the fixed piece 32 and a lower surface of an almost central portion of the movable piece 33 are connected to each other through a coupling portion 34 which is almost perpendicular to both of the pieces 32 and 33. A fixing leg portion 35 (a fixed portion) for bonding the connecting terminal 31 to an electrode pad 42 of a circuit board through a solder is protruded from a lower surface of a tip portion of the fixed piece 32. The fixing leg portion 35 is exposed from a lower surface of a housing when the connecting terminal 31 is inserted into a terminal inserting hole of the housing and is thus incorporated into the housing. The fixing leg portion 35 is bonded to the electrode pad 42 of the circuit board through a solder so that a connector is mounted on the circuit board. A movable contact 36 taking a shape of a triangular projection is provided on a lower surface of a tip portion of the movable piece 33, and a rear end of the movable piece 33 serves as an operation receiving portion 37 for tilting the movable piece 33 through a cam portion (which will be described below).

Figure 6:
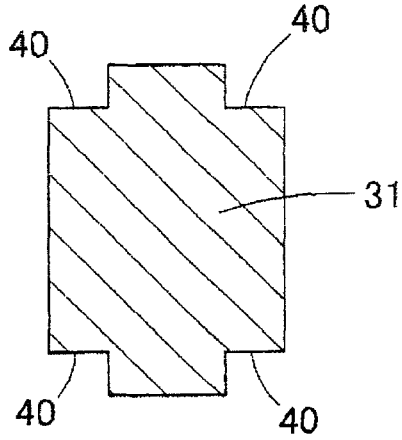
FIG. 6(A) is a schematic view showing a section of the connecting terminal for a connector according to the first embodiment.
FIG. 6(B) is a schematic view showing a state in which a fixing leg portion of the connecting terminal for a connector is bonded to an electrode pad through a solder.
FIG. 6(C) is a schematic view showing a state in which a movable contact of the connecting terminal for a connector is caused to come in contact with a contact portion of a flexible printed circuit board.
Figure 6:
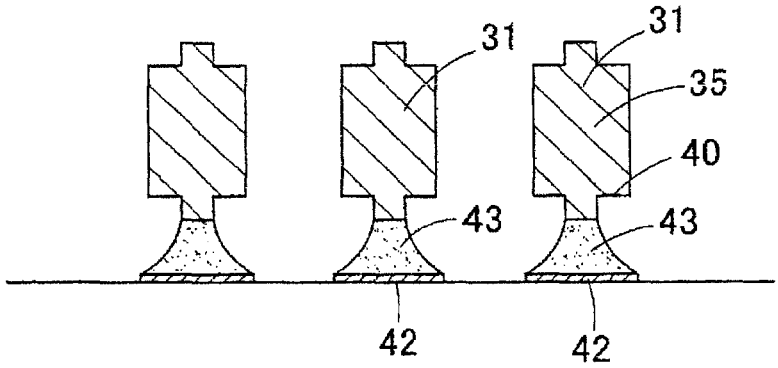
Figure 6:
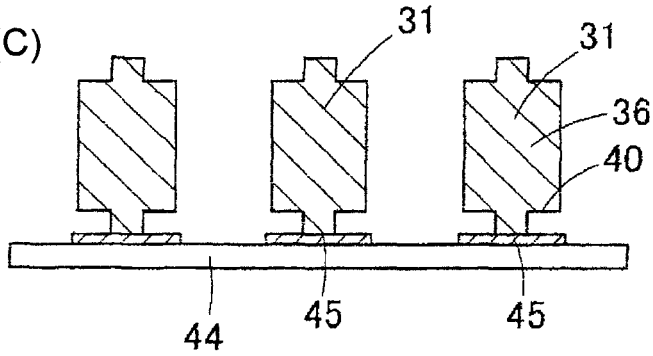

The connecting terminal 31 has both side surfaces which are flat except for the vicinity of an outer peripheral surface thereof, and a width between the both side surfaces is uniform. A circular concave portion 40 is formed along an outer peripheral surface of the connecting terminal 31 at both side ends provided in contact with the both side surfaces in the outer peripheral surface thereof. Accordingly, the connecting terminal 31 has four corner portions dented in an L shape in an optional section as shown in FIG. 6(A). In particular, each of the fixing leg portion 35 and the movable contact 36 also has the concave portion 40 formed on both sides and a part between the concave portions 40 is protruded outward in a section thereof.

As shown in FIG. 6(B), a lower surface of the fixing leg portion 35 is bonded to the electrode pad 42 of the circuit board through a solder 43 so that the connecting terminal 31 is mechanically fixed to the electrode pad 42, and furthermore, is electrically connected to the electrode pad 42. Since the concave portion 40 is provided, an area of the lower surface of the fixing leg portion 35 (that is, an area of a lower surface of a protruded part between the concave portions 40) is decreased. When the fixing leg portion 35 is bonded to the electrode pad 42 through a solder, a spread of the solder 43 is also reduced at the electrode pad 42 side. Even if an array pitch of the connecting terminal 31 is reduced, a short circuit occurs with difficulty between the adjacent connecting terminals 31 or electrode pads 42 through the spread solder 43. As a result, the array pitch of the connecting terminal 31 can be reduced and a flexible printed circuit board having a small wiring pitch can be used.

Figure 1:
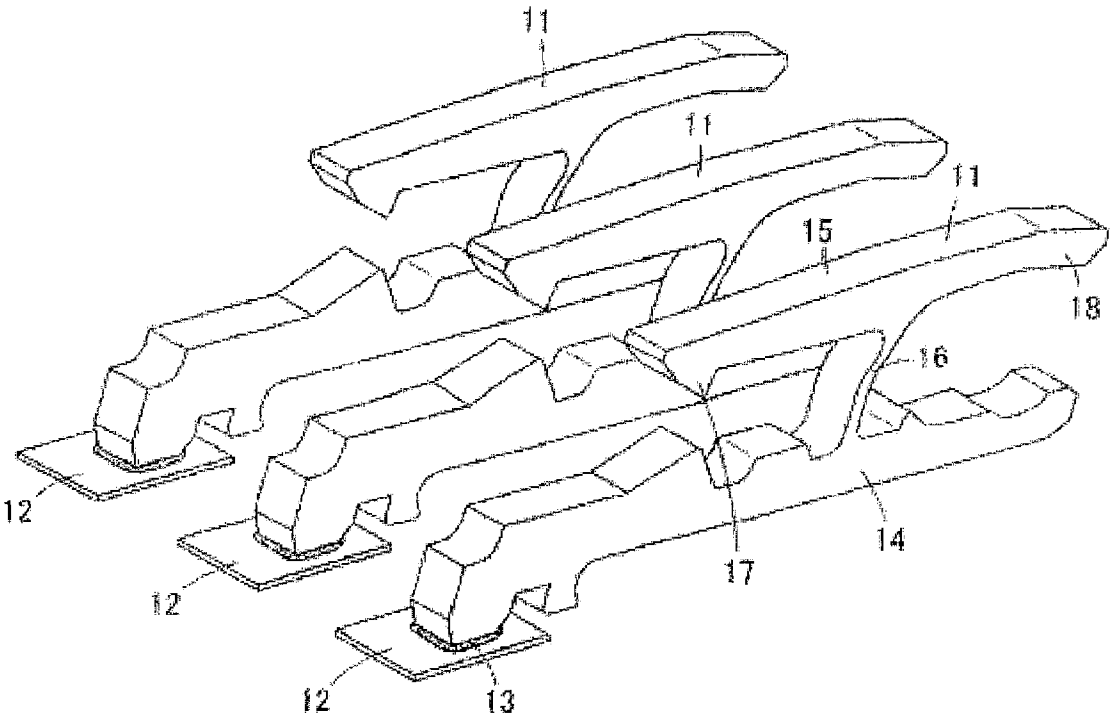
Fig. 1 PRIOR ART
FIG. 1 is a perspective view showing a connecting terminal for a connector according to the related art which is bonded to an electrode pad.
Figure 3:
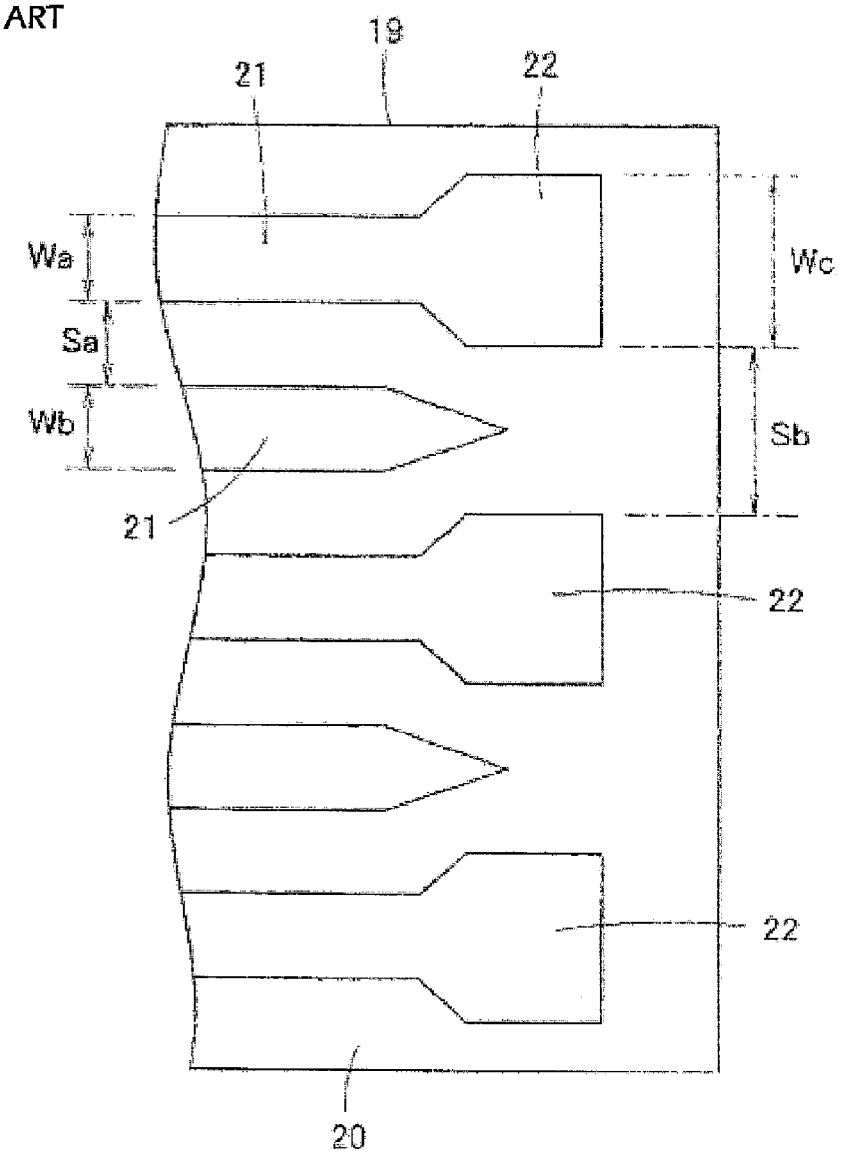
Fig. 3 PRIOR ART
FIG. 3 is an enlarged plan view showing an end of a flexible printed circuit board.
Figure 4:
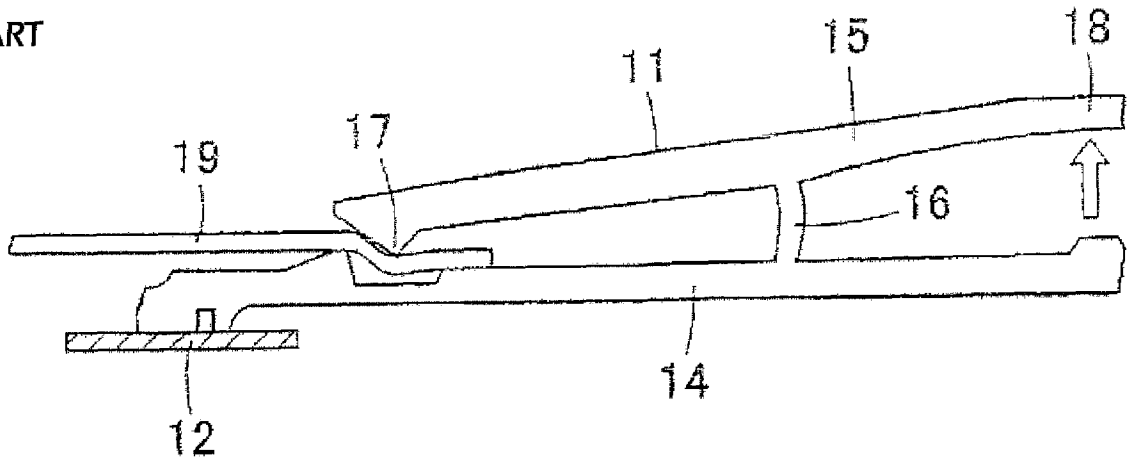
Fig. 4 PRIOR ART
FIG. 4 is a side view showing the connecting terminal for a connector to which the flexible printed circuit board is connected.

When an end of the flexible printed circuit board is inserted between the fixed piece 32 and the movable piece 33 in the connecting terminal 31 and the cam portion is operated to push the operation receiving portion 37 upward, the flexible printed circuit board is caused to mate and is thus held between the movable contact 36 of the movable piece 33 and a trench portion 38 and a stopper portion 39 in the fixed piece 32 (see FIG. 4). At this time, the movable contact 36 comes in pressure contact with a contact portion 45 of a flexible printed circuit board 44 to electrically connect the connecting terminal 31 to the contact portion 45 as shown in FIG. 6(C). The movable contact 36 has the concave portion 40 formed on both sides and an area of a tip portion is reduced. Accordingly, a contact area of the movable contact 36 and the contact portion 45 is reduced so that a contact pressure of the movable contact 36 is raised. In addition, a width of a contact portion of the movable contact 36 is reduced. Therefore, it is possible to use the flexible printed circuit board 44 having a small wiring pitch.

In the connecting terminal 31, furthermore, the concave portion 40 is provided on only the outer peripheral surface. Therefore, a thickness is not reduced in a region in a major part and a spring property or a rigidity of the connecting terminal 31 is rarely changed. For this reason, the flexible printed circuit board 44 is caused to mate with a portion between the fixed piece 32 and the movable contact 36 or a force for pressing the movable contact 36 against the contact portion 45 is reduced with difficulty.

Figure 7:
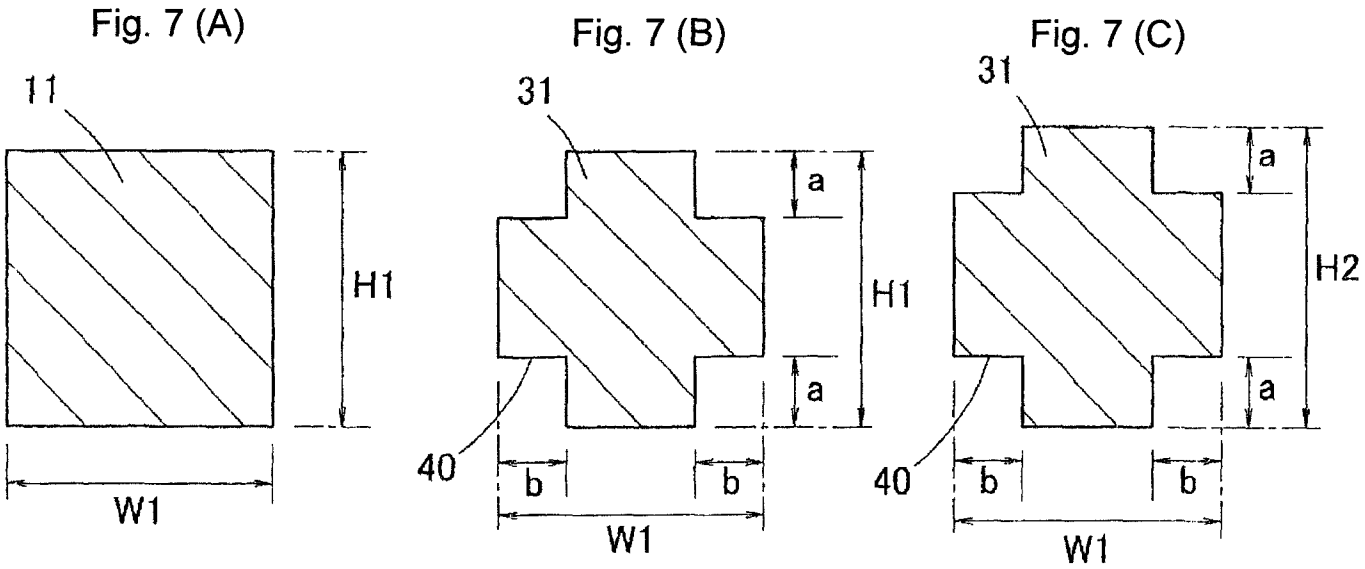
FIG. 7(A) is a sectional view showing a connecting terminal for a connector taking a rectangular section.
FIG. 7(B) is a sectional view showing the connecting terminal for a connector according to the first embodiment.
FIG. 7(C) is a sectional view showing the connecting terminal for a connector according to the first embodiment in which a height of the section is slightly increased.

FIGS. 7(A), 7(B) and 7(C) show samples for evaluating a reduction in the spring property of the connecting terminal 31 through the provision of the concave portion 40.

The sample of FIG. 7(A) indicates a beam member having a rectangular section in a width W1=100 μm and a height H1=100 μm. A geometrical moment of inertia with respect to a horizontal direction of the beam member is as follows.

$$W1 \times H1^3 = 100\ \mu m \times (100\ \mu m)^3$$
$$= 1.0 \times 10^8\ \mu m^4$$

The sample of FIG. 7(B) has such a structure that the concave portion 40 taking a sectional L shape of a=b=15 μm in vertical and transverse directions is provided in four corners of the beam member taking the rectangular section in a width W1=100 μm and a height H1=100 μm. A geometrical moment of inertia with respect to the horizontal direction of the beam member is as follows.

$$(W1 - 2b) \times H1^3 + 2 \times b \times (H1 - 2a)^3 = 0.8029 \times 10^8 \mu m^4$$

A value of the geometrical moment of inertia is 80.3% of the sample having the rectangular section of FIG. 7(A), and the geometrical moment of inertia is simply reduced by a little less than 20%.

The sample of FIG. 7(C) has such a structure that the concave portion 40 taking a sectional L shape of a=b=15 μm in vertical and transverse directions is provided in four corners of the beam member taking the rectangular section in a width W1=100 μm and a height H2=107 μm. A geometrical moment of inertia with respect to the horizontal direction of the beam member is as follows.

$$(W1 - 2b) \times H2^3 + 2 \times b \times (H2 - 2a)^3 = 0.99449 \times 10^8\ \mu m^4$$

A value of the geometrical moment of inertia is 99.4% of the sample having the rectangular section of FIG. 7(A), and the reduction in the geometrical moment of inertia has no problem in respect of a design.

Accordingly, it is apparent that a reduction in the spring property or the rigidity of the connecting terminal 31 due to the provision of the concave portion 40 can be sufficiently compensated through an increase of approximately several % in a height at an end face thereof.

Moreover, the connecting terminal 31 is assembled by inserting the fixed piece 32 into an inserting hole provided on the housing of the connector as will be described below. According to the connecting terminal 31 having such a structure, however, it is possible to easily carry out the insertion into the inserting hole in a process for assembling the connector. In other words, the concave portion 40 is formed on the outer peripheral surface of the connecting terminal 31. In a process for manufacturing the connecting terminal 31, therefore, a burr or a warp is generated in the corner of the connecting terminal 31 with difficulty. For this reason, the insertion is not disturbed by the burr or the warp. Consequently, it is possible to easily insert the connecting terminal 31 into the inserting hole of the housing. By providing the concave portion 40 on the connecting terminal 31, furthermore, a contact area (an area of a frictional surface) in a press insertion into the inserting hole is decreased. Consequently, it is possible to easily insert the connecting terminal 31.

Since the burr or the warp is generated in the corner of the connecting terminal 31 with difficulty, moreover, catching does not occur in a movement of the movable piece 33 through the cam portion. Consequently, an operation of the movable piece 33 is stabilized.

In addition, there are also advantages that a weight of the connecting terminal 31 can be reduced through the provision of the concave portion 40 and an employed material can be saved. For example, the connecting terminal having the sectional dimension shown in FIG. 7(C) has a sectional area which is 98% of a sectional area of the connecting terminal having the sectional dimension shown in FIG. 7(A).

(Connecting Terminal for Connector According to Second Embodiment)

Figure 8:
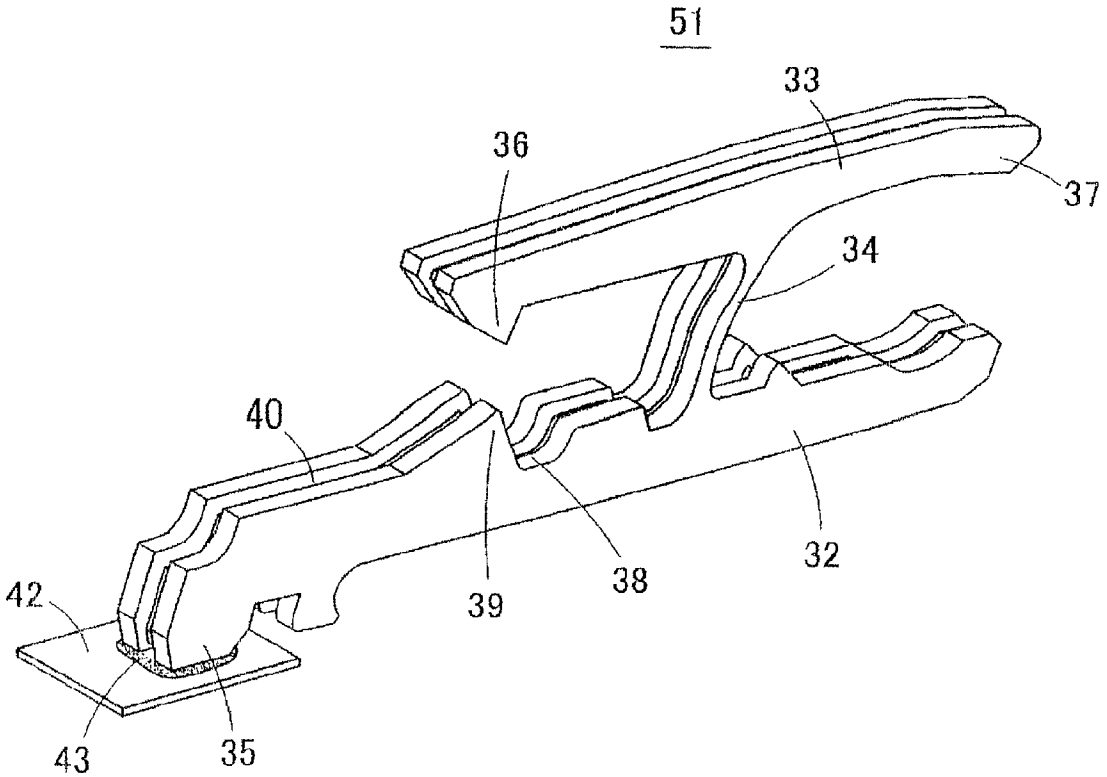
FIG. 8 is a perspective view showing a connecting terminal for a connector according to a second embodiment of the present invention.

FIG. 8 is a perspective view showing a connecting terminal 51 for a connector according to a second embodiment of the present invention. Moreover, FIG. 9(A) is a sectional view showing the connecting terminal 51.

In the connecting terminal 51, a concave portion 40 is formed on a center in a transverse direction along an outer peripheral surface thereof. Since the concave portion 40 is provided on the whole outer peripheral surface, it is formed circularly. Moreover, the concave portion 40 is formed like a trench having a rectangular section. Since other respects are the same as those of the connecting terminal 31 according to the first embodiment, description will be omitted.

Figure 9:
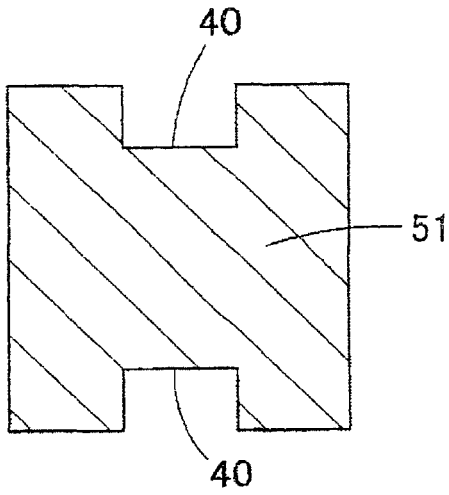
FIG. 9(A) is a schematic view showing a section of the connecting terminal for a connector according to the second embodiment.
FIG. 9(B) is a schematic sectional view showing a state in which a fixing leg portion of the connecting terminal for a connector is bonded to an electrode pad through a solder.
FIG. 9(C) is a schematic sectional view showing a state in which a movable contact of the connecting terminal for a connector is caused to come in contact with a contact portion of a flexible printed circuit board.
Figure 9:
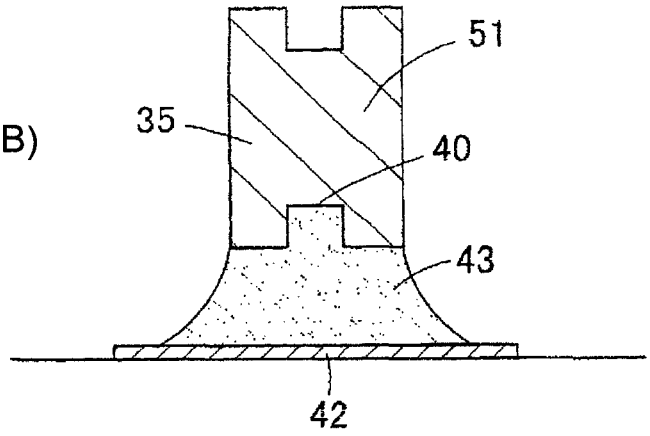
Figure 9:
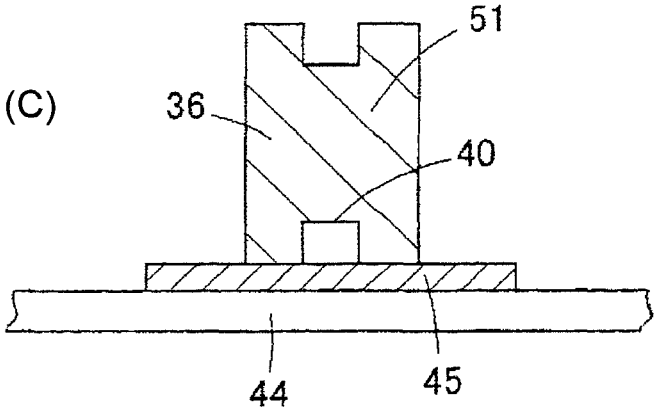

In the connecting terminal 51, as shown in FIG. 9(B), a width of an adhesion of a solder 43 is equal to that in the case in which no concave portion 40 is provided when a fixing leg portion 35 is to be bonded to a pad 42 through a solder. However, an extra solder 43 is absorbed into the concave portion 40. Therefore, a spread of the solder 43 at the electrode pad 42 side is reduced. Even if an array pitch of the connecting terminal 51 is reduced, therefore, a short circuit occurs between the connecting terminals 51 through the spreading solder 43 with difficulty. As a result, it is possible to reduce the array pitch of the connecting terminal 51. Thus, it is possible to use a flexible printed circuit board having a small wiring pitch.

Moreover, a movable contact 36 has the concave portion 40 formed in a central part. Therefore, a contact area with a contact portion 45 is decreased. For this reason, a contact pressure of the movable contact 36 and the contact portion 45 is raised. In the connecting terminal 51, furthermore, the movable contact 36 comes in contact with the contact portion 45 in two places (at both sides of the concave portion 40). Consequently, a contact reliability of the movable contact 36 can be enhanced. Therefore, it is also possible to correspond to a fine current. Furthermore, a width of a contact part of the movable contact 36 is reduced. Thus, it is possible to use a flexible printed circuit board 44 having a small wiring pitch.

In addition, referring to the connecting terminal 51, an insertion into an inserting hole of a housing can easily be carried out, a weight can be reduced and an employed material can be saved in the same manner as in the first embodiment.

(Connecting Terminal Taking Other Sectional Shape)

It is possible to use connecting terminals for connectors which take various sectional shapes in addition to those described in the first and second embodiments. An example is shown in FIGS. 10(A) to 10(D) and FIGS. 11(A) to 11(D).

Figure 10:
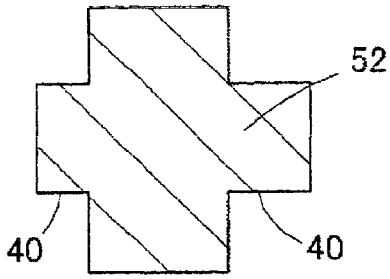
FIGS. 10(A) to 10(D) are views illustrating sectional shapes of connecting terminals for connectors according to various embodiments.
Figure 10:
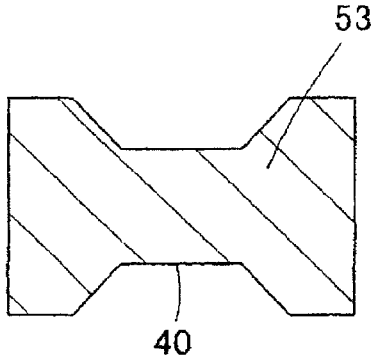
Figure 10:
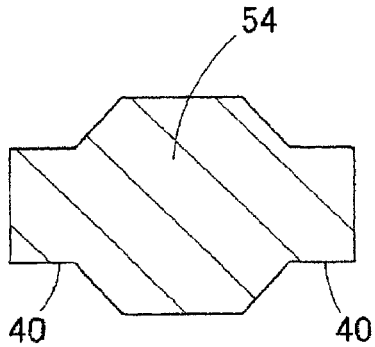
Figure 10:
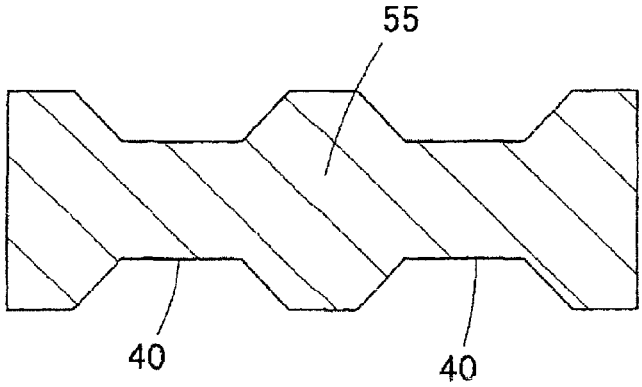

A connecting terminal 52 shown in FIG. 10(A) has a concave portion 40 provided on both side ends of an outer peripheral surface and causes widths of left and right concave portions 40 to be different from each other. A connecting terminal 53 shown in FIG. 10(B) has the concave portion 40 provided in a central part of an outer peripheral surface and both side wall surfaces of the concave portion 40 are tilted. A connecting terminal 54 shown in FIG. 10(C) has the concave portion 40 provided on both side ends of an outer peripheral surface, and a side wall surface of the concave portion 40 is tilted. In a connecting terminal 55 shown in FIG. 10(D), two concave portions 40 having both side wall surfaces tilted are provided close to a central part of an outer peripheral surface.

Figure 11:
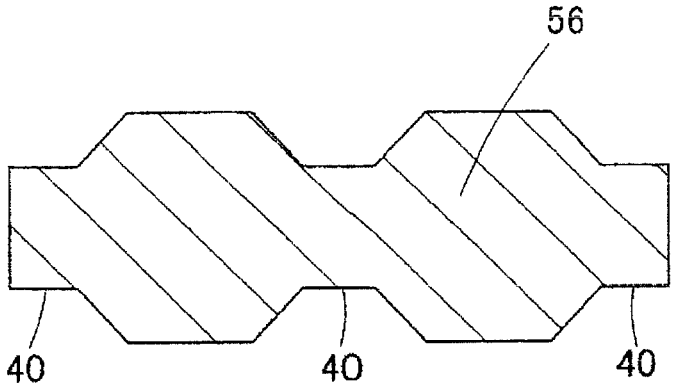
FIGS. 11(A) to 11(D) are views illustrating sectional shapes of connecting terminals for connectors according to various embodiments.
Figure 11:
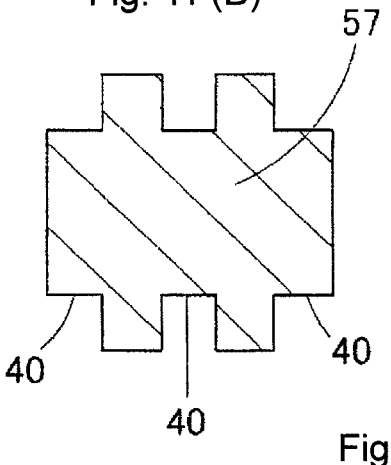
Figure 11:
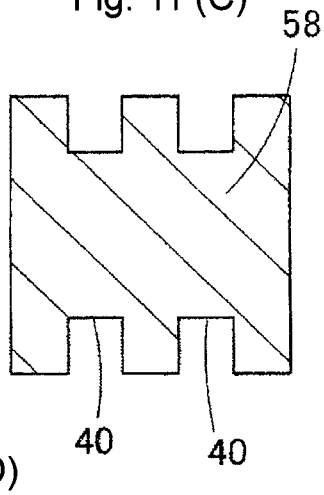
Figure 11:
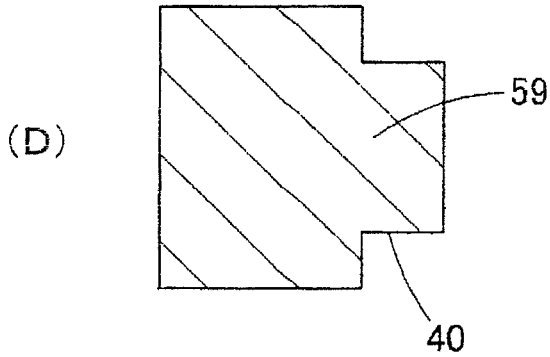

A connecting terminal 56 shown in FIG. 11(A) has the concave portion 40 provided on both side ends of an outer peripheral surface and a central part, and each side wall surface of the concave portion 40 is tilted. A connecting terminal 57 shown in FIG. 11(B) has the concave portion 40 provided on both side ends of an outer peripheral surface and a central part, and each side wall surface is set to be perpendicular to the outer peripheral surface. A connecting terminal 58 shown in FIG. 11(C) has two concave portions 40 provided close to a central part of an outer peripheral surface, and each side wall surface is set to be perpendicular to the outer peripheral surface. A connecting terminal 59 shown in FIG. 11(D) has the concave portion 40 provided on either of left and right side ends of an outer peripheral surface.

In the sectional shapes, by tilting the side wall surface of the concave portion 40 to reduce a width at a bottom face of the concave portion 40 and to reduce a width on an opening side of the concave portion 40 as shown in FIGS. 10(B) to 10(D) and 11(A), it is possible to relieve a reduction in a spring property or a rigidity of the connecting terminal while decreasing an area of a contact surface of the connecting terminal. In the connecting terminals shown in FIGS. 10(B), 10(D) and 11(A) to 11(C), moreover, a contact surface of the movable contact 36 is obtained in a plurality of places through the concave portion 40. Therefore, the movable contact 36 comes in contact with a contact portion 45 in a plurality of places. Consequently, it is possible to enhance a contact reliability of the movable contact 36, thereby corresponding to a fine current. On the other hand, in the connecting terminals shown in FIGS. 10(A), 10(C), 11(A) and 10(B), a burr or a warp occurs with difficulty.

(First Manufacturing Method)

Next, a method of manufacturing a connecting terminal for a connector according to one or more embodiments of the present invention will be described. FIGS. 12(A) to 12(D), 13(A) to 13(D), and 14(A) to 14(D) show a first method of manufacturing a connecting terminal through an electroforming process.

Figure 12:
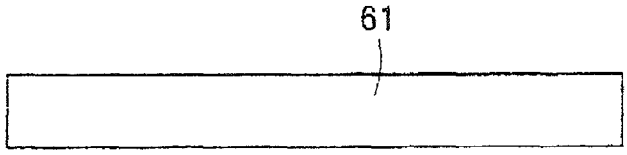
FIGS. 12(A) to 12(D) are schematic sectional views showing a first method of manufacturing a connecting terminal of a connector according to one or more embodiments of the present invention.
Figure 12:
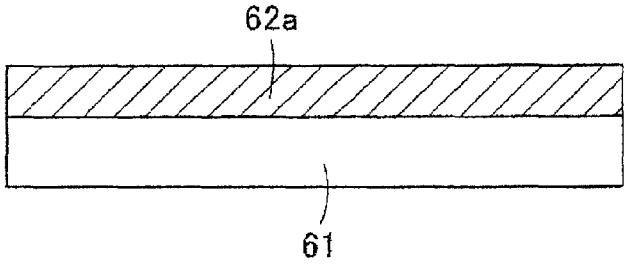
Figure 12:
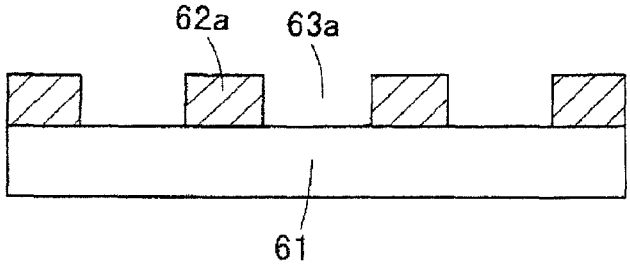
Figure 12:
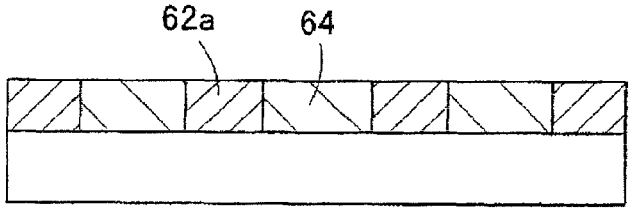

In the manufacturing method, an electroforming electrode plate 61 shown in FIG. 12(A) is used. The electrode plate 61 is a substrate having a conductivity, that is, a metal plate, a plate formed by a conductive substance, or a plate formed by a non-conductive material and having a surface coated with a conductive substance. A negative resist 62*a* is applied to an upper surface of the electrode plate 61 as shown in FIG. 12(B), for example, and is then exposed to the resist 62*a*. At an exposing step, an opening forming region of the resist 62*a* is covered with an exposure mask in such a manner that a light is not exposed to the opening forming region. When the resist 62*a* is developed, subsequently, only a portion insolubilized by the exposure remains on the electrode plate 61. Therefore, a plurality of openings 63*a* taking a shape of a connecting terminal is formed on the resist 62*a* as shown in FIG. 12(C).

As shown in FIG. 12(D), then, an electroforming material 64 is deposited in the opening 63*a* of the resist 62*a* through an electroforming process to take a predetermined shape. The electroforming material 64 to be used contains, as a principal component, Ni, Co, Fe, Cu, Mn, Sn or Zn and may be their alloy. When the electroforming material 64 is grown to have a sufficient thickness, a surface of the electroforming material 64 is polished and arranged to be flat.

Figure 13:
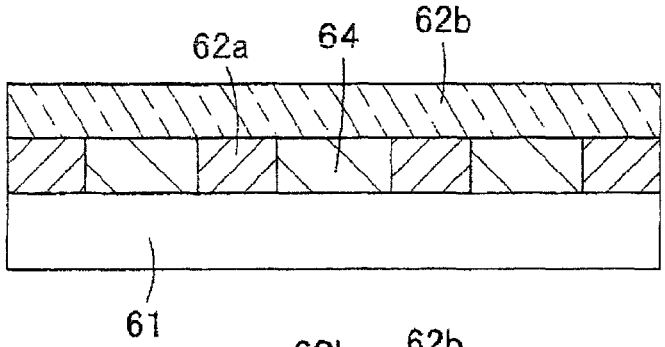
FIGS. 13(A) to 13(D) are schematic sectional views showing the first method of manufacturing a connecting terminal for a connector according to one or more embodiments of the present invention, illustrating a step after FIG. 12(D).
Figure 13:
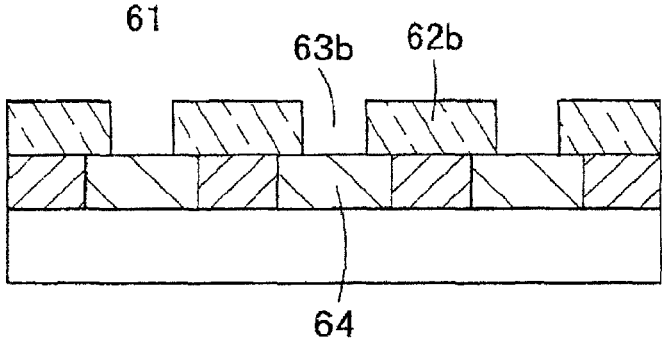
Figure 13:
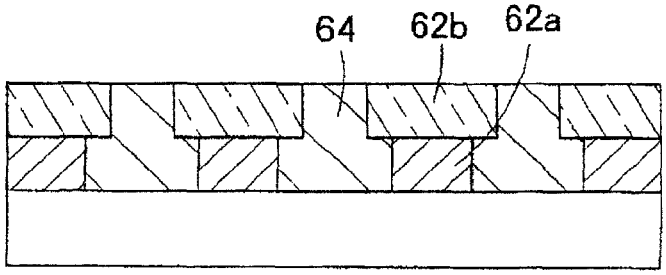
Figure 13:
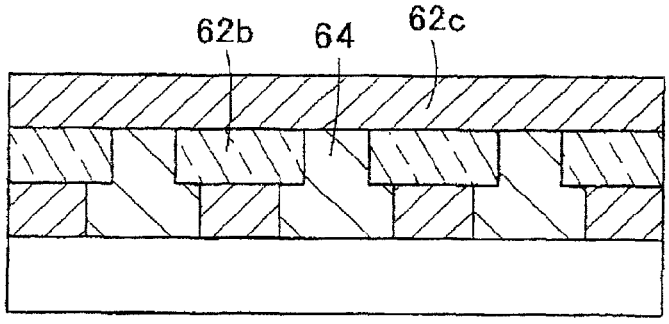

As shown in FIG. 13(A), thereafter, a resist 62*b* is applied onto the resist 62*a* and the electroforming material 64 again to cover the surface of the electroforming material 64 with the resist 62*b*. An exposure and a development are carried out over the resist 62*b* and an opening 63*b* is formed on the resist 62*b* as shown in FIG. 13(B). The opening 63*b* takes a similar shape to the opening 63*a* of the resist 62*a* and is set to be slightly smaller than the opening 63*a*. At a next step, the electroforming material 64 is grown in the opening 63*b* by the electroforming process as shown in FIG. 13(C).

Figure 14:
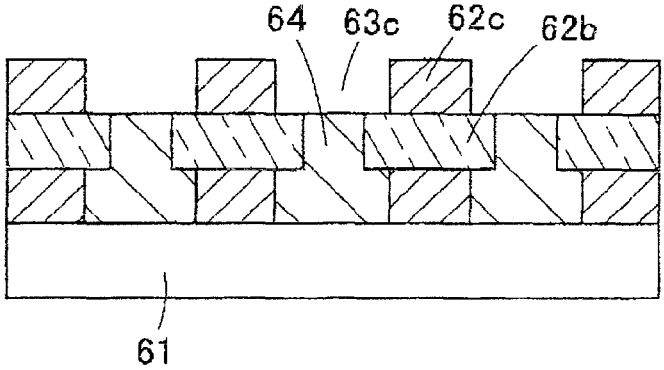
FIGS. 14(A) to 14(D) are schematic sectional views showing the first method of manufacturing a connecting terminal for a connector according to one or more embodiments of the present invention, illustrating a step after FIG. 13(D).
Figure 14:
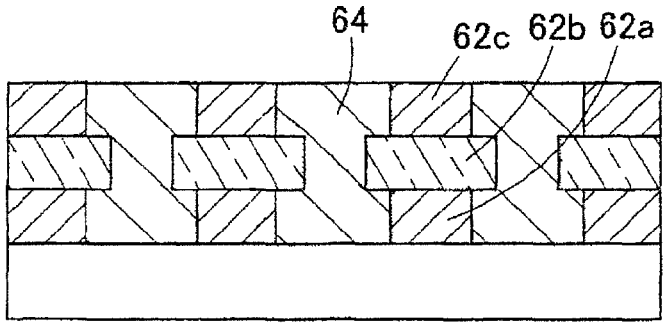
Figure 14:
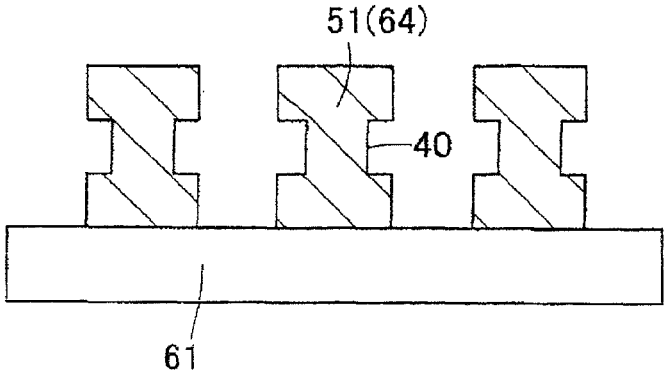
Figure 14:
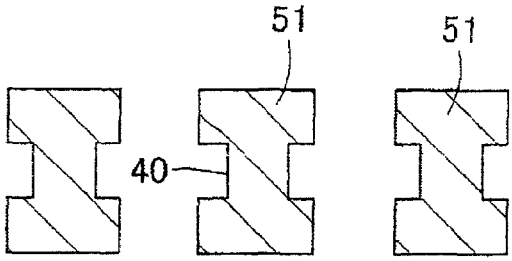

After the surface of the electroforming material 64 is polished and arranged to be flat, furthermore, a resist 62*c* is applied onto the resist 62*b* and the electroforming material 64 and the surface of the electroforming material 64 is thus covered with the resist 62*c* as shown in FIG. 13(D). The resist 62*c* is exposed and developed so that an opening 63*c* is formed on the resist 62*c* as shown in FIG. 14(A). The opening 63*c* takes the same shape as that of the opening 63*a* of the resist 62*a*. As shown in FIG. 14(B), next, the electroforming material 64 is grown in the opening 63*c* through the electroforming process.

Then, the surface of the electroforming material 64 is polished and arranged to be flat if necessary. Thereafter, the resists 62*a*, 62*b* and 62*c* are removed by wet etching. As shown in FIG. 14(C), thus, a plurality of connecting terminals 51 is formed on the upper surface of the electrode plate 61 by the electroforming material 64. In the connecting terminal 51 thus obtained, a concave portion 40 is formed on a center of an outer peripheral surface because the opening 63*b* of the resist 62*b* is one size smaller. Finally, each of the connecting terminals 51 is released from the electrode plate 61 so that a target connecting terminal 51 is obtained.

Although the description has been given by using the negative resist as a resist, each resist may be a negative resist, a positive resist or a dry film resist. According to one or more embodiments of the present invention, a thickness of a resist having a layer is equal to or smaller than 500 μm. The reason is that a time is excessively required for growing the electroforming material 64 if the thickness is greater. According to one or more embodiments of the present invention, the thickness of the resist is equal to or greater than 10 μm and be equal to or smaller than 300 μm. By causing the sizes of the openings 63*a*, 63*b* and 63*c* to be different from each other, moreover, it is possible to manufacture connecting terminals taking different sectional shapes. For example, if the opening 63*b* is set to be larger than the openings 63*a* and 63*c*, it is possible to manufacture the connecting terminal 31. If the thicknesses of the respective resists 62*a*, 62*b* and 62*c* are set to be different from each other, furthermore, it is possible to change a width of the concave portion 40 or a protruded portion which is adjacent to the concave portion 40. The foregoing is also applicable to the following other manufacturing methods as long as there is not particular explanation.

(Second Manufacturing Method)

Next, a second method of manufacturing a connecting terminal through an electroforming process will be described with reference to FIGS. 15(A) to 15(D), 16(A) to 16(C), 17(A) and 17(B).

Figure 15:
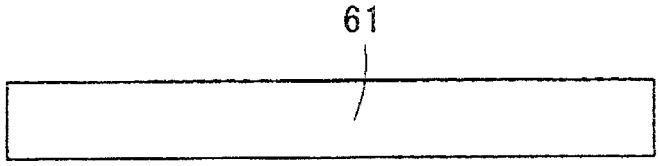
FIGS. 15(A) to 15(D) are schematic sectional views showing a second method of manufacturing a connecting terminal for a connector according to one or more embodiments of the present invention.
Figure 15:
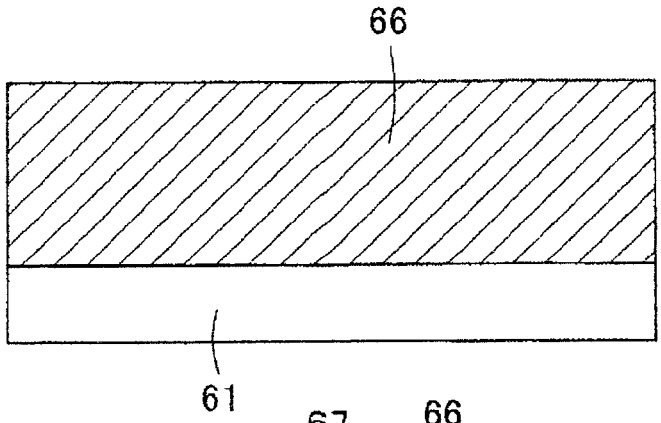
Figure 15:
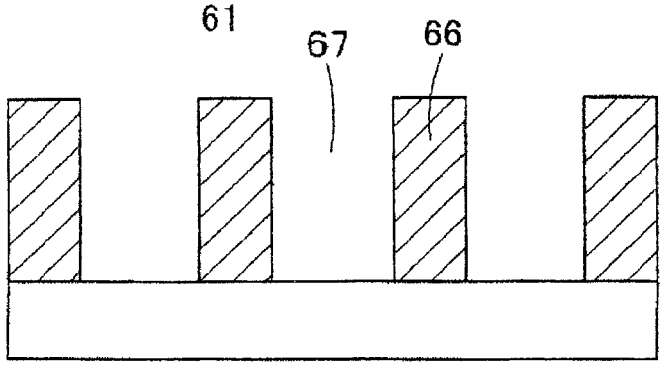
Figure 15:
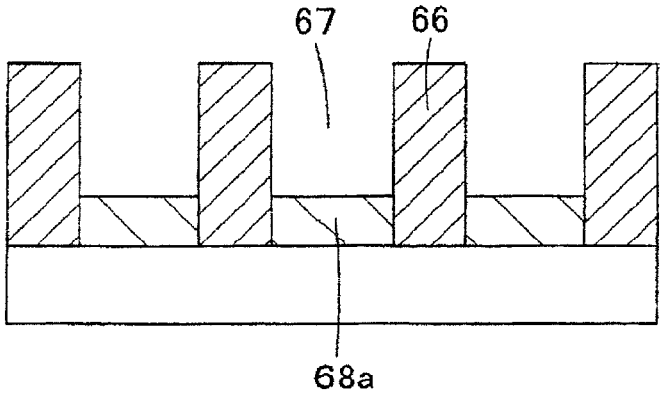

Referring to the manufacturing method, a resist 66 is applied to an upper surface of an electrode plate 61 in FIG. 15(A) as shown in FIG. 15(B) so that the resist 66 having a great thickness is formed. Subsequently, the resist 66 is exposed and developed and an opening 67 taking a shape of a connecting terminal is formed on the resist 66 as shown in FIG. 15(C).

Figure 16:
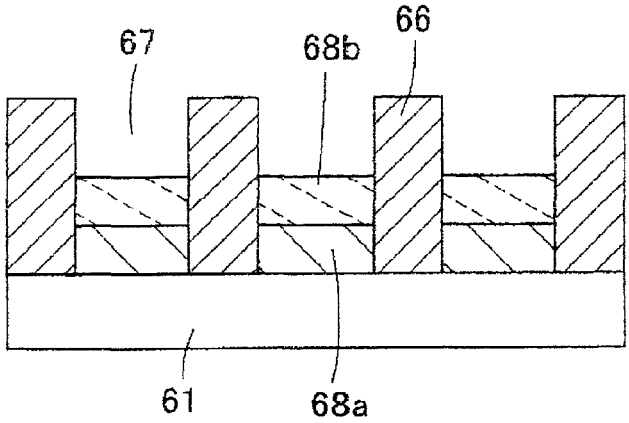
FIGS. 16(A) to 16(C) are schematic sectional views showing the second method of manufacturing a connecting terminal for a connector according to one or more embodiments of the present invention, illustrating a step after FIG. 15(D).
Figure 16:
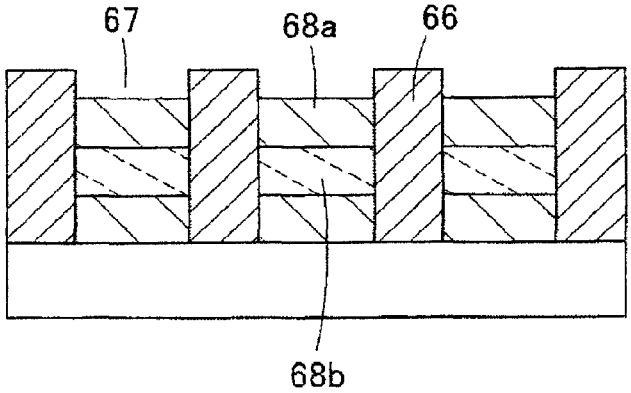
Figure 16:
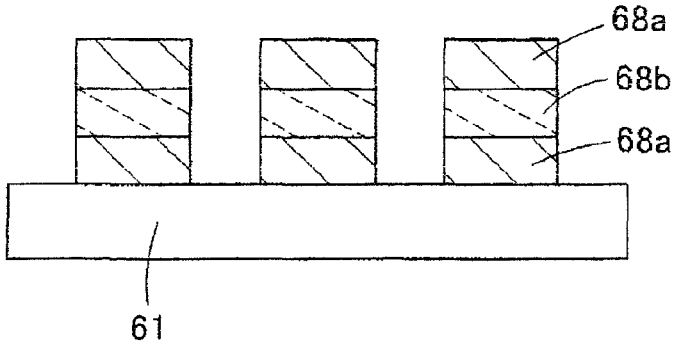

As shown in FIG. 15(D), then, an electroforming material 68*a* is deposited in the opening 67 through an electroforming process in order to have a desirable thickness. Thereafter, an electroforming material 68*b* is deposited on an upper surface of the electroforming material 68*a* in the opening 67 through the electroforming process in order to have a desirable thickness as shown in FIG. 16(A). The electroforming material 68*b* is of a different type from the electroforming material 68*a*, that is, a material having a different etching rate to an etchant to be used. As shown in FIG. 16(B), furthermore, an electroforming material 68*a* is deposited on an upper surface of the electroforming material 68*b* in the opening 67 through the electroforming process in order to have a desirable thickness. As a result, an inner part of the opening 67 has a sandwich structure in which the electroforming material 68*b* of a different type is interposed between the same electroforming materials 68*a*.

Figure 17:
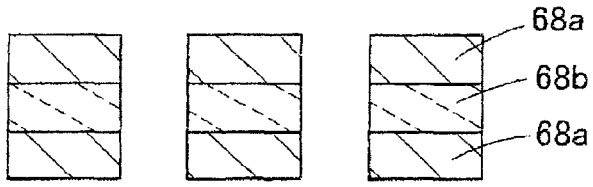
FIGS. 17(A) and 17(B) are schematic sectional views showing the second method of manufacturing a connecting terminal for a connector according to one or more embodiments of the present invention, illustrating a step after FIG. 16(C).
Figure 17:
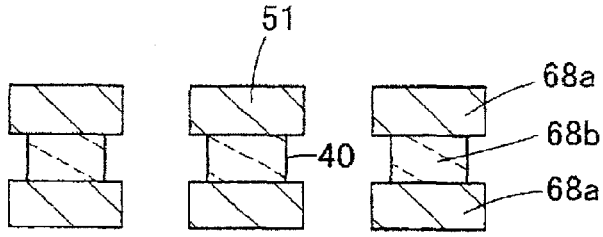

As shown in FIG. 16(C), subsequently, the resist 66 is removed by wet etching. As a result, the electroforming materials 68*a*, 68*b* and 68*c* are integrally laminated in the same shape on the upper surface of the electrode plate 61, and the electroforming material 68*b* of the different type is interposed between the same electroforming materials 68*a* and 68*a* in upper and lower parts. The electroforming materials 68*a*, 68*b* and 68*a* are released from the electrode plate 61 as shown in FIG. 17(A) and only the electroforming material 68*b* is then immersed in an etchant having a high etching rate. Only an outer peripheral surface of the electroforming material 68*b* provided in the middle is exposed from the electroforming materials 68*a* and 68*a*. For this reason, the etching is sequentially carried out from the outer peripheral surface so that a concave portion 40 is obtained. A depth of the concave portion 40 is subjected to a time management. When the concave portion 40 having a predetermined depth is formed, the electroforming materials 68*a*, 68*b* and 68*a* are taken out of the etchant and are neutralized with an alkaline solution, and are subjected to washing and drying so that a connecting terminal 51 shown in FIG. 17(B) is obtained.

Herein, the resist 66 has the structure in which an electroforming material having a plurality of layers is sequentially deposited. Therefore, there is no restriction to the thickness of the resist 66.

(Third Manufacturing Method)

Next, a third method of manufacturing a connecting terminal through an electroforming process will be described with reference to FIGS. 18(A) to 18(C), 19(A) to 19(C), 20(A) and 20(B).

Figure 18:
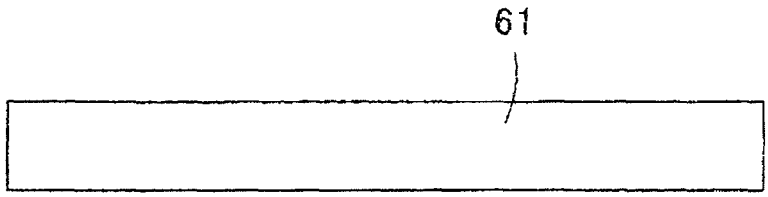
FIGS. 18(A) to 18(C) are schematic sectional views showing a third method of manufacturing a connecting terminal for a connector according to one or more embodiments of the present invention.
Figure 18:
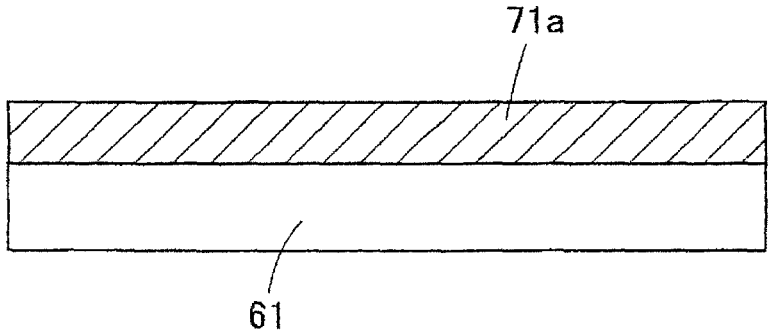
Figure 18:
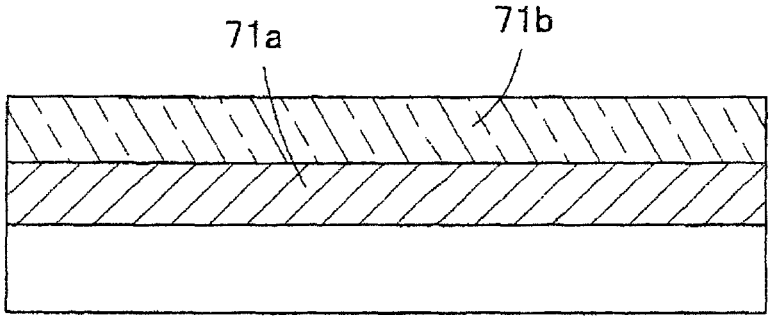
Figure 19:
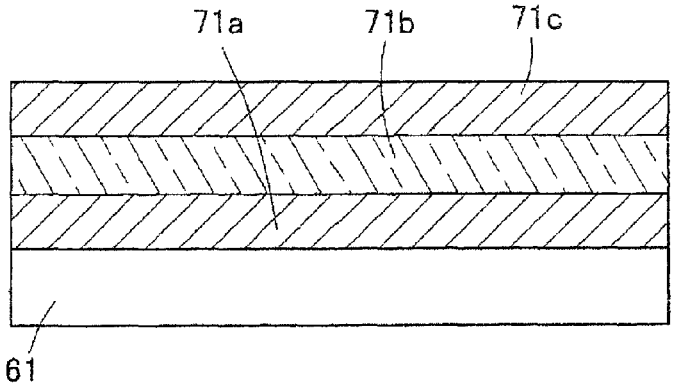
FIGS. 19(A) to 19(C) are schematic sectional views showing the third method of manufacturing a connecting terminal for a connector according to one or more embodiments of the present invention, illustrating a step after FIG. 18(C).
Figure 19:
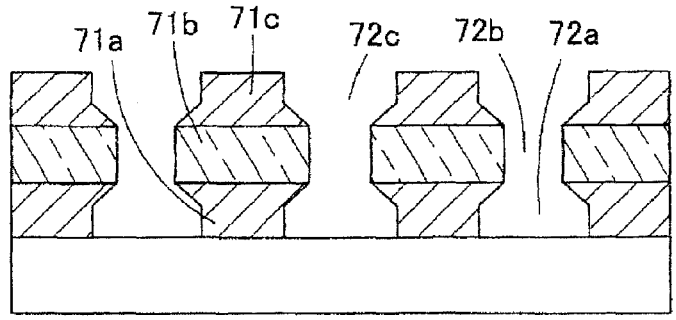
Figure 19:
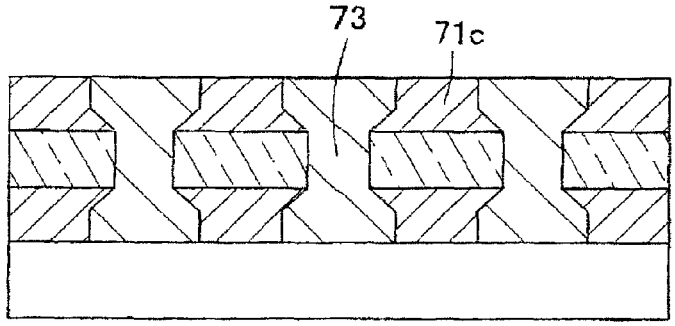

Referring to the manufacturing method, first of all, a resist 71*a* is formed as a film through an application onto an upper surface of the electrode plate 61 illustrated in FIG. 18(A) as shown in FIG. 18(B). The resist 71*a* is a positive resist having a high exposure sensitivity, that is, a positive resist having a high photocuring speed. As shown in FIG. 18(C), subsequently, a resist 71*b* is formed as a film through an application onto the resist 71*a*. The resist 71*b* is a positive resist having a low exposure sensitivity, that is, a positive resist having a low photocuring speed. As shown in FIG. 19(A), furthermore, a resist 71*c* is formed as a film through an application onto the resist 71*b*. The resist 71*c* is a positive resist having a high exposure sensitivity, that is, a positive resist having a high photocuring speed. According to one or more embodiments of the present invention, the resist 71*c* is the same as the resist 71*a*.

When the resists 71*a*, 71*b* and 71*c* to be three layers are exposed and developed, then, openings 72*a*, 72*b* and 72*c* are formed on the resists 71*a*, 71*b* and 71*c* as shown in FIG. 19(B) respectively. The upper and lower resists 71*a* and 71*c* are positive resists having a high sensitivity. Therefore, a place exposed to a light is easily solubilized so that the openings 72*a* and 72*c* are enlarged. On the other hand, the resist 71*b* provided in the middle is a positive resist having a low sensitivity. Therefore, a place exposed to a light is solubilized with difficulty so that the opening 72*b* is enlarged with difficulty. As a result, the openings 72*a*, 72*b* and 72*c* formed by a photolithography are narrowed in a central part.

Figure 20:
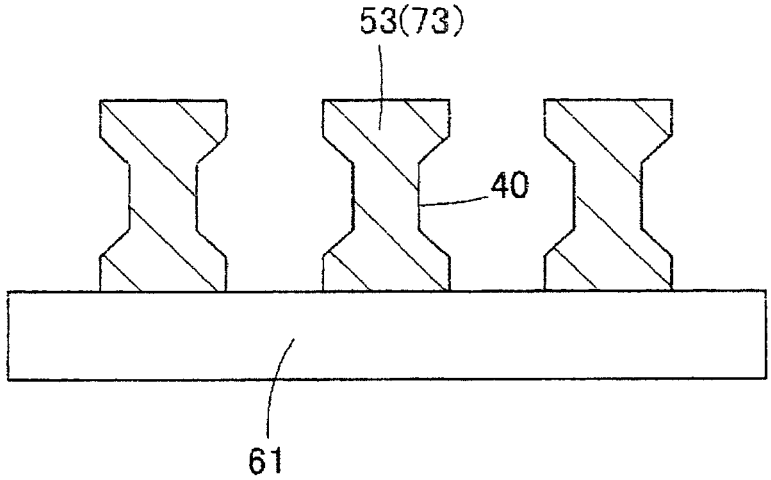
FIGS. 20(A) and 20(B) are schematic sectional views showing the third method of manufacturing a connecting terminal for a connector according to one or more embodiments of the present invention, illustrating a step after FIG. 19(C).
Figure 20:
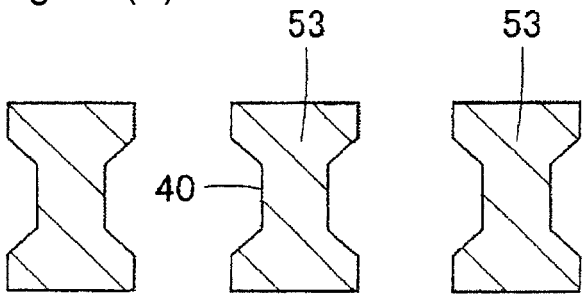
Figure 21:
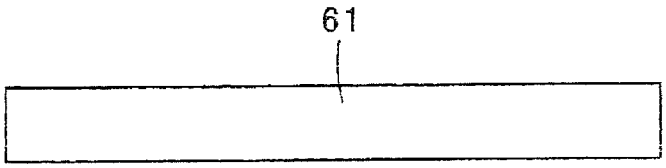
FIGS. 21(A) to 21(D) are schematic sectional views showing a fourth method of manufacturing a connecting terminal for a connector according to one or more embodiments of the present invention.
Figure 21:
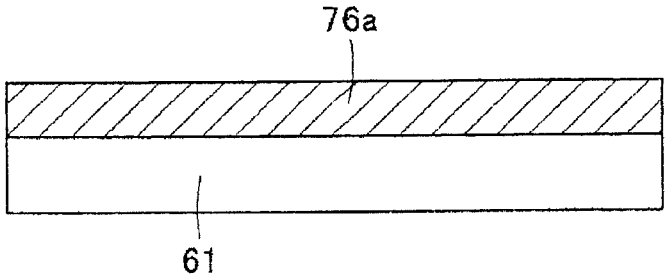
Figure 21:
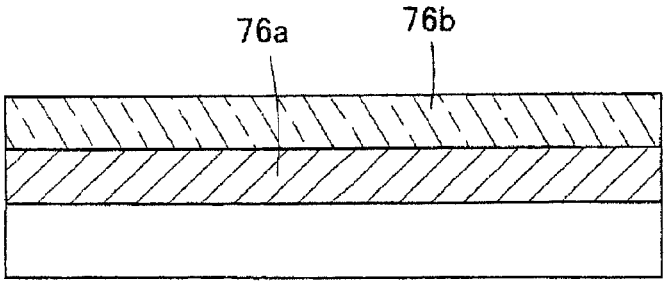
Figure 21:
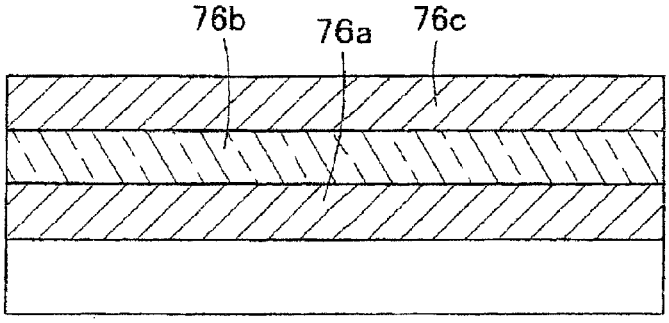

As shown in FIG. 19(C), subsequently, an electroforming material 73 is grown in the openings 72*a*, 72*b* and 72*c* through an electroforming process. As shown in FIG. 20(A), a circular concave portion 40 is formed in the middle of an outer peripheral surface of the electroforming material 73 when the resists 71*a*, 71*b* and 71*c* are removed by etching. By releasing the electroforming material 73 from the electrode plate 61, it is possible to obtain a single connecting terminal 53 as shown in FIG. 20(B).

In the case in which the negative resist is used, according to one or more embodiments of the present invention, the upper and lower resists 71*a* and 71*c* are negative resists having low sensitivities and the intermediate resist 71*b* is a negative resist having a high sensitivity.

In the case in which the concave portion 40 is formed on both side ends of an outer peripheral surface as in the connecting terminal 54 shown in FIG. 10(C), moreover, according to one or more embodiments of the present invention, the upper and lower resists 71*a* and 71*c* are positive resists having low sensitivities and the intermediate resist 71*b* is a positive resist having a high sensitivity. Alternatively, the upper and lower resists 71*a* and 71*c* may be negative resists having high sensitivities and the intermediate resist 71*b* may be a negative resist having a low sensitivity.

(Fourth Manufacturing Method)

FIGS. 21(A) to 21(D) and 22(A) to 22(D) are views for explaining a fourth method of manufacturing a connecting terminal through an electroforming process.

Referring to the manufacturing method, first of all, resists 76*a*, 76*b* and 76*c* are sequentially laminated on an upper surface of an electrode plate 61 as shown in FIGS. 21(A) to 21(D). In the resists, the resist 76*a* to be a lower layer and the resist 76*c* to be an upper layer are the same, and the intermediate resist 76*b* is of a different type from the resists 76*c* and 76*a* to be the upper and lower layers. As a method of laminating the resists 76*a*, 76*b* and 76*c*, an application of a liquid resist and baking may be repeated to carry out the lamination or a dry film resist may be superposed. In the case in which the dry film resist is used, the dry film resist NIT 215 manufactured by Nichigo-Morton Co., Ltd. is used as the resists 76*a* and 76*c* and the NEF 150 manufactured by the Nichigo-Morton Co., Ltd. is used as the resist 76*b*, for example.

Figure 22:
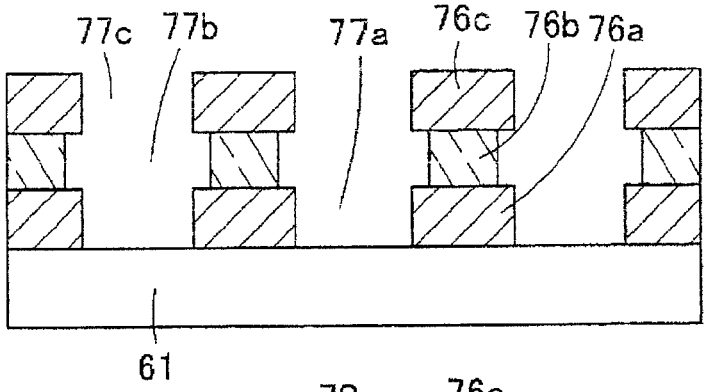
FIGS. 22(A) to 22(D) are schematic sectional views showing the fourth method of manufacturing a connecting terminal for a connector according to one or more embodiments of the present invention, illustrating a step after FIG. 21(D).
Figure 22:
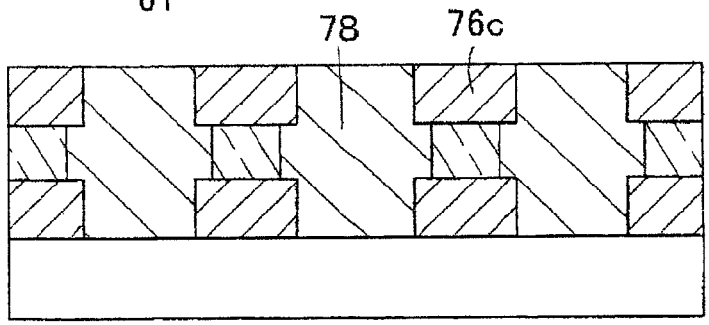
Figure 22:
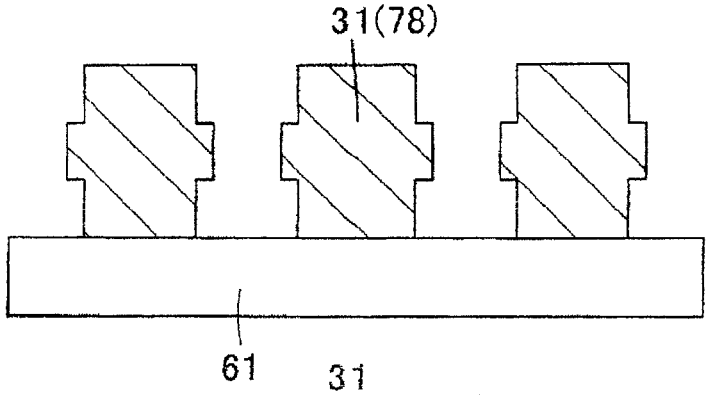
Figure 22:
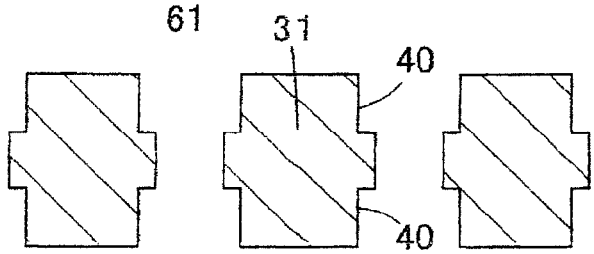

As shown in FIG. 22(A), subsequently, the resists 76*a*, 76*b* and 76*c* to be the three layers are exposed and developed so that openings 77*a*, 77*b* and 77*c* are formed on the resists 76*a*, 76*b* and 76*c*, respectively. At this time, a difference in a reactivity to a developing solution between the resists 76*a* and 76*c* and the resist 76*b* is utilized to selectively etch the resists 76*c* and 76*a* which are upper and lower layers and to cause sizes of the openings 77*c* and 77*a* of the upper and lower layers to be different from the size of the central opening 77*b*.

As shown in FIG. 22(B), then, an electroforming material 78 is deposited in the openings 77*a*, 77*b* and 77*c* through an electroforming process. As shown in FIG. 22(C), when the resists 76*a*, 76*b* and 76*c* are removed by etching, a connecting terminal is formed by the electroforming material 78 on the upper surface of the electrode plate 61. The connecting terminal acts as the connecting terminal 31 in the case in which the opening 77*b* is larger than the openings 77*a* and 77*c* as shown in the drawing. To the contrary, in the case in which the opening 77*b* is smaller than the openings 77*a* and 77*c*, the connecting terminal acts as the connecting terminal 51. When the electroforming material 78 is released from the electrode plate 61, subsequently, it is possible to obtain the single connecting terminal 31 (or 51) as shown in FIG. 22(D).

(Fifth Manufacturing Method)

FIGS. 23(A) to 23(C) and 24(A) to 24(C) are views for explaining a fifth method of manufacturing a connecting terminal through an electroforming process.

Referring to the manufacturing method, in the same manner as the fourth manufacturing method, resists 81*a*, 81*b* and 81*c* are sequentially laminated on an upper surface of an electrode plate 61. At least the resist 81*b* is of a different type from the other resists 81*a* and 81*c*. Although the resists 81*a* and 81*c* are set to have the same type, any of the resists 81*a*, 81*b* and 81*c* may be of a different type from the others. In the case in which a dry film resist is used, the dry film resist NIT 215 manufactured by the Nichigo-Morton Co., Ltd. is used as the resists 81*a* and 81*c* and the NEF 250 manufactured by the Nichigo-Morton Co., Ltd. is used as the resist 81*b*.

Figure 23:
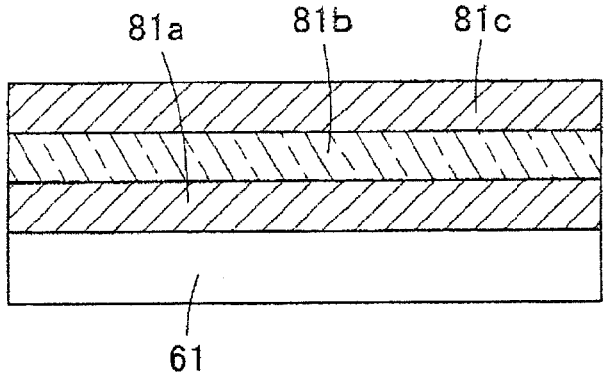
FIGS. 23(A) to 23(C) are schematic sectional views showing a fifth method of manufacturing a connecting terminal for a connector according to one or more embodiments of the present invention.
Figure 23:
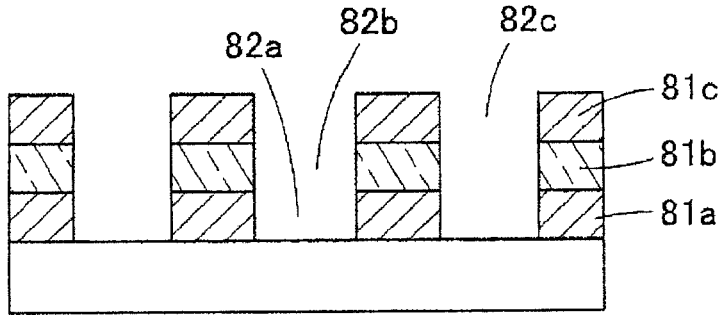
Figure 23:
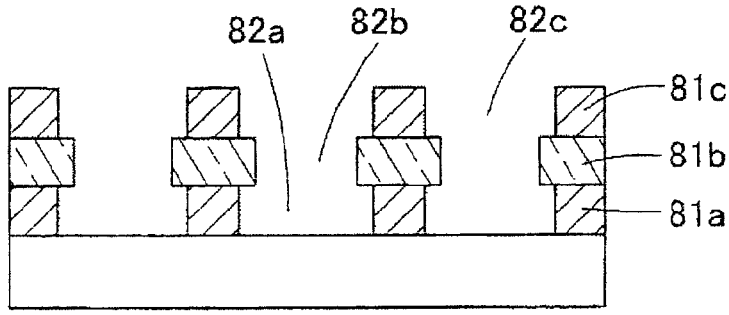

As shown in FIG. 23(B), subsequently, the resists 81*a*, 81*b* and 81*c* to be three layers are exposed and developed so that openings 82*a*, 82*b* and 82*c* having the same size are formed on the resists 81*a*, 81*b* and 81*c*, respectively. Then, an etchant is introduced into each of the openings 82*a*, 82*b* and 82*c* to etch an inner part of the opening. The etchant to be used at this time has a high etching rate to the resists 81*a* and 81*c* and a low etching rate to the resist 81*b*. As a result, as shown in FIG. 23(C), the opening 82*b* is not enlarged but the upper and lower openings 82*c* and 82*a* are enlarged by the etching.

Figure 24:
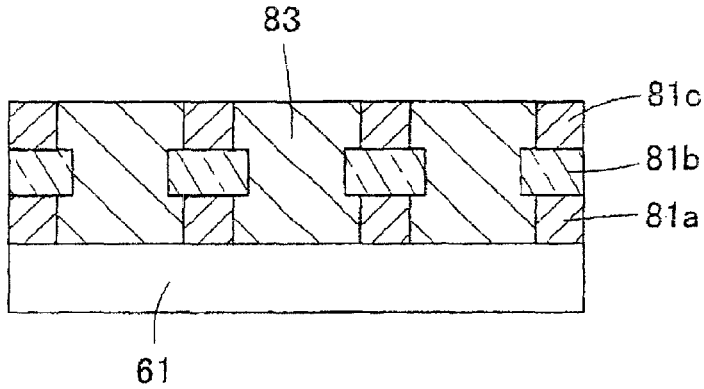
FIGS. 24(A) to 24(C) are schematic sectional views showing the fifth method of manufacturing a connecting terminal for a connector according to one or more embodiments of the present invention, illustrating a step after FIG. 23(C).
Figure 24:
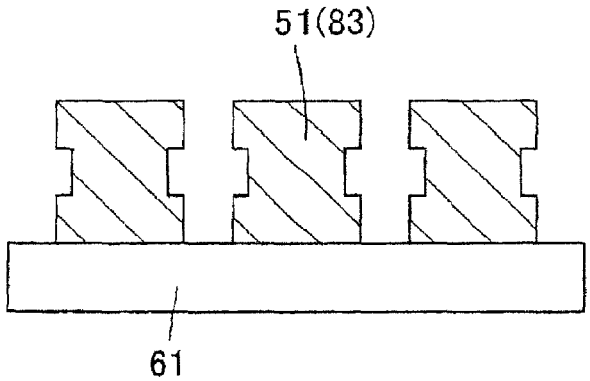
Figure 24:
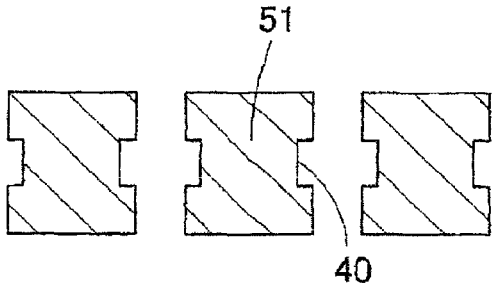
Figure 25:
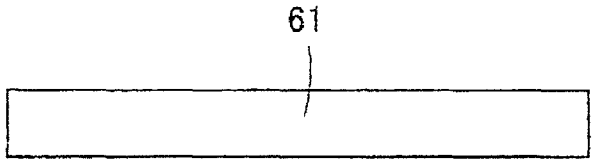
FIGS. 25(A) to 25(C) are schematic sectional views showing an example of a method of manufacturing a connecting terminal for a connector by using a resist having fifth layers.
Figure 25:
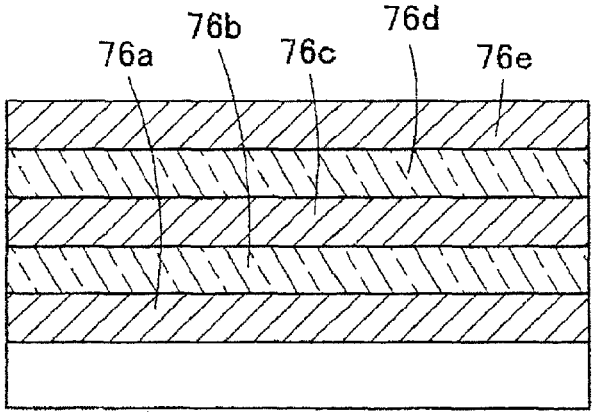
Figure 25:
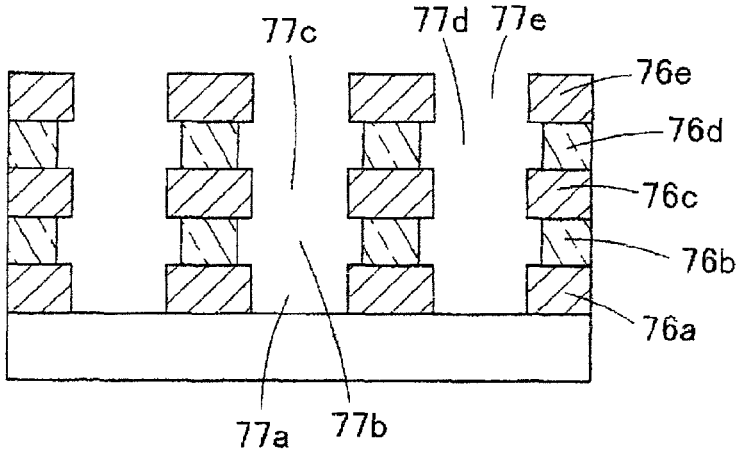

As shown in FIG. 24(A), thereafter, an electroforming material 83 is deposited in the openings 82*a*, 82*b* and 82*c* through an electroforming process. As shown in FIG. 24(B), when the resists 81*a*, 81*b* and 81*c* are removed by etching, a connecting terminal 51 is formed by the electroforming material 83 on the upper surface of the electrode plate 61. When the electroforming material 83 is released from the electrode plate 61, subsequently, it is possible to obtain the single connecting terminal 51 as shown in FIG. 24(C).

(Other Manufacturing Method)

Figure 26:
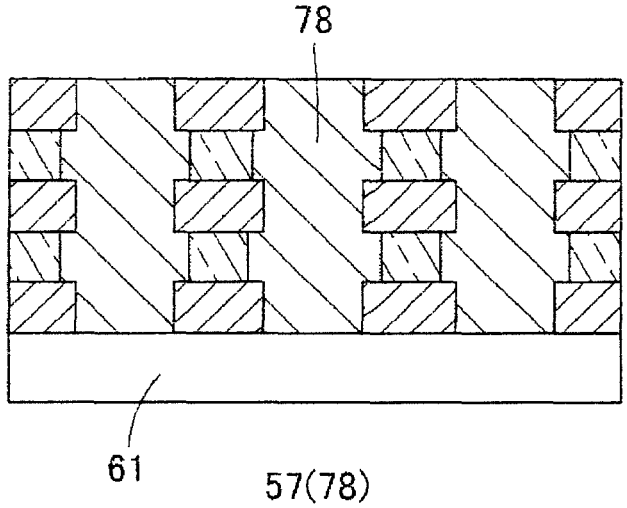
FIGS. 26(A) to 26(C) are schematic sectional views showing a subsequent step to the step of FIG. 25(C).
Figure 26:
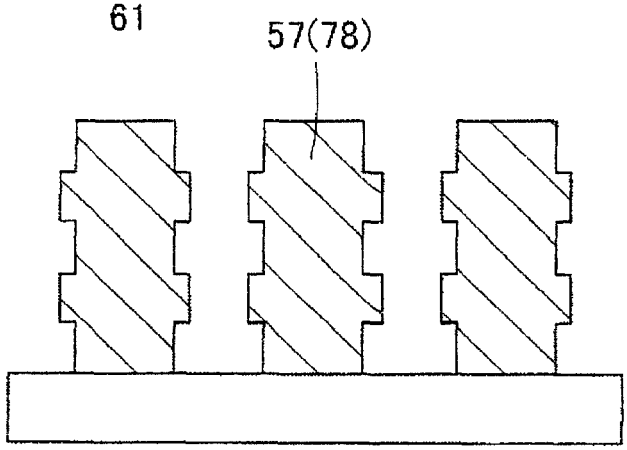
Figure 26:
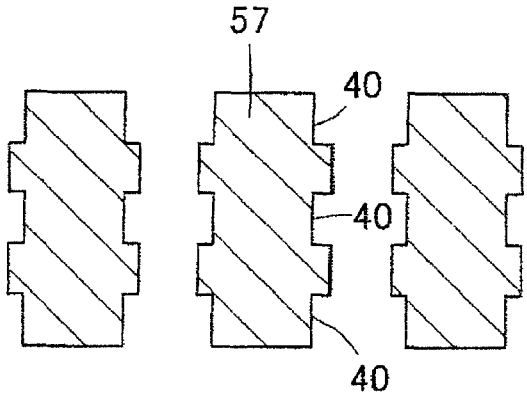
Figure 27:
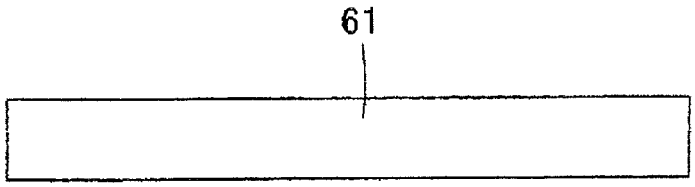
FIGS. 27(A) to 27(D) are schematic sectional views showing an example of a method of manufacturing a connecting terminal for a connector by using a resist having two layers.
Figure 27:
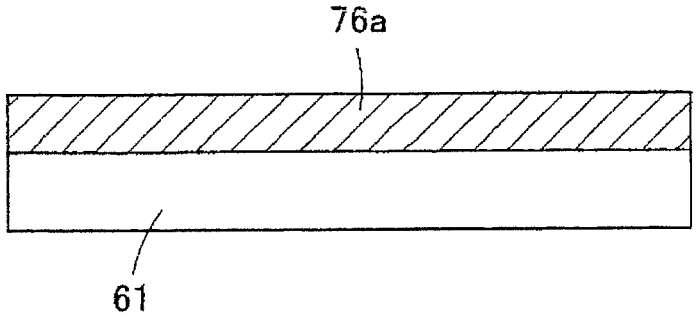
Figure 27:
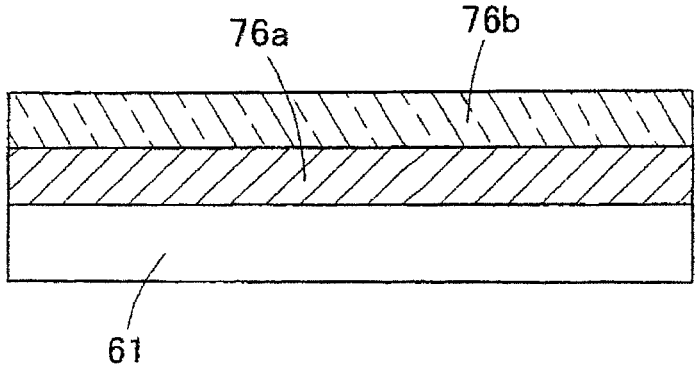
Figure 27:
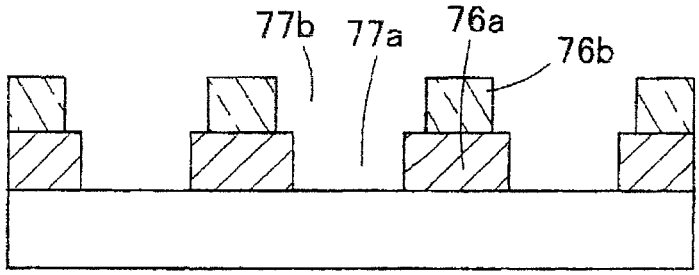

Although the description has been given to the case in which the resist is laminated to be three layers in the first to fifth manufacturing methods, it is possible to obtain a more complicated sectional shape by an increase in the number of concave portions 40 if the resist is set to have at least four layers. For example, in FIGS. 25(A) to 25(C) and 26(A) to 26(C), five resists 76*a* to 76*e* are laminated in the fourth manufacturing method. Although the resists 76*a*, 76*c* and 76*e* are of the same type (dry film resists) and the resists 76*b* and 76*d* are also of the same type (dry film resists), the resists 76*a*, 76*c* and 76*e* are of a different type from the resists 76*b* and 76*d*. Also in this case, the openings 77*a*, 77*c* and 77*e* have different areas from those of the openings 77*b* and 77*d* by selective etching through a development. Therefore, a connecting terminal 57 having three concave portions 40 is finally manufactured as shown in FIG. 26(B) or 26(C).

Figure 28:
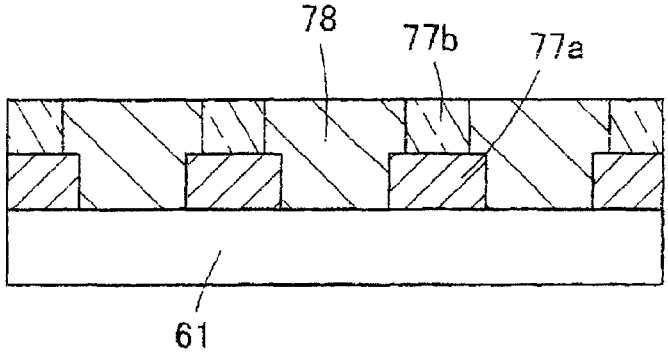
FIGS. 28(A) to 28(C) are schematic sectional views showing a subsequent step to the step of FIG. 27(D).
Figure 28:
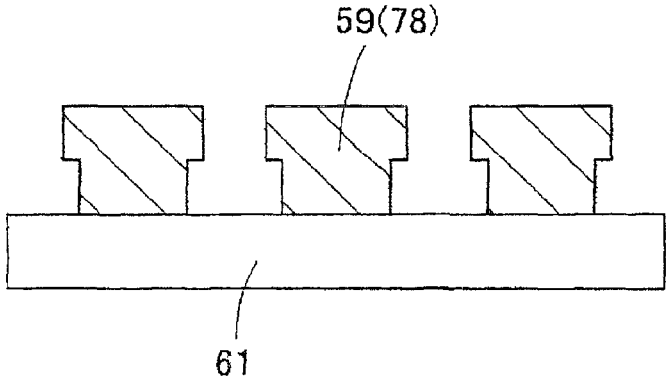
Figure 28:
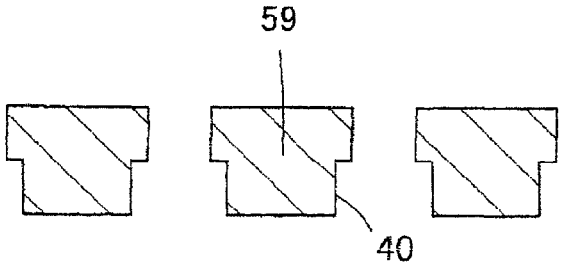

If the resist is set to have at least two layers, moreover, only one concave portion 40 is enough. For example, in FIGS. 27(A) to 27(D) and FIGS. 28(A) to 28(C), two resists 76*a* and 76*b* are laminated in the fourth manufacturing method. The resist 76*a* is of a different type from the resist 76*b*. Also in this case, openings 77*a* and 77*b* have different areas from each other by selective etching through a development. Therefore, a connecting terminal 59 having a single concave portion 40 is finally manufactured as shown in FIG. 28(B) or 28(C).

(Contrast to Comparative Example)

According to the methods of manufacturing a connecting terminal for a connector in accordance with one or more embodiments of the present invention, a connecting terminal for a connector which has a concave portion formed circularly on an outer peripheral surface can be manufactured at a simple step using an electroforming process.

As a general method of manufacturing a connecting terminal, a connecting terminal taking a predetermined shape is cut out of a metal plate by a pressing device. Accordingly, as a method of manufacturing a connecting terminal having a concave portion formed on both side edges of an outer peripheral surface, for example, a connecting terminal having the section shown in FIG. 6(A), it is possible to propose a method of crashing an edge of a connecting terminal by pressing (a comparative example) in addition to the methods according to one or more embodiments of the present invention.

FIGS. 29(A) to 29(E) are views for explaining the comparative example. FIG. 29(A) illustrates a metal plate 91 to be a material of a connecting terminal. Referring to the method according to the comparative example, first of all, the metal plate 91 is pressed from both front and back sides by means of a die 92 as shown in FIG. 29(B) and a thin portion 93 is formed around a shape of a connecting terminal as shown in FIG. 29(C). As shown in FIG. 29(D), subsequently, the metal plate 91 is pressed through the thin portion 93 to cut a connecting terminal 95 out of the metal plate 91 by using a cutting die 94. At this time, if the metal plate 91 is cut out to leave the thin portion 93 around the connecting terminal 95, a concave portion 96 can be formed on both side edges of an outer peripheral surface of the connecting terminal 95 as shown in FIG. 29(E).

Figure 29:
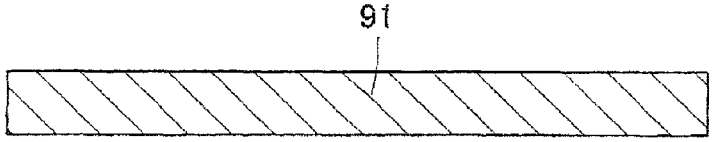
FIGS. 29(A) to 29(E) are schematic views showing a process for manufacturing a connecting terminal for a connector according to a comparative example.
Figure 29:
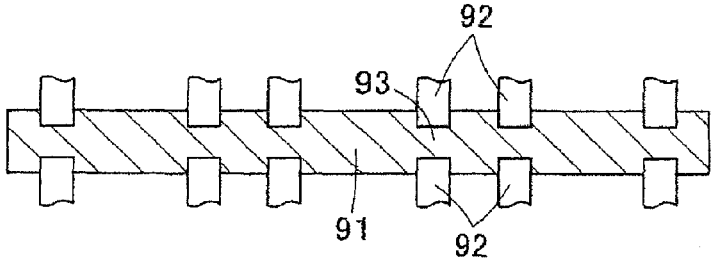
Figure 29:
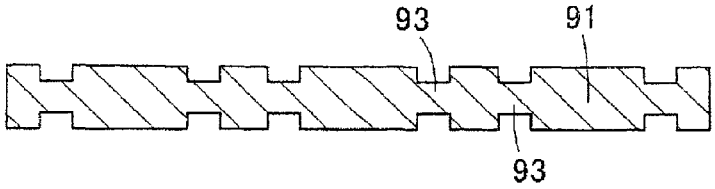
Figure 29:
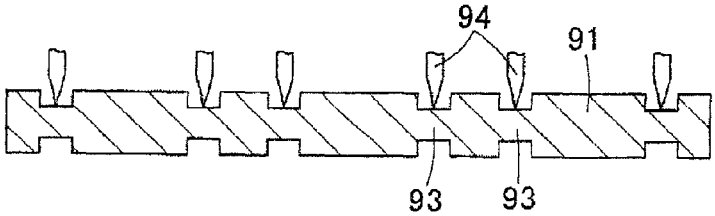
Figure 29:
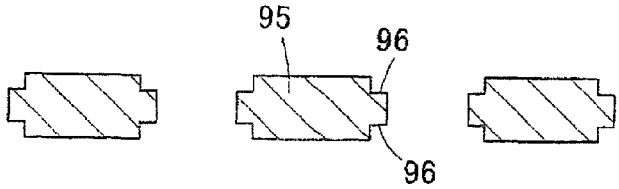

Referring to the method according to the comparative example shown in FIG. 29, however, a material of a metal plate which is pushed out of a thin portion is swollen in a peripheral portion when the metal plate is crushed by pressing to form the thin portion. For this reason, when a connecting terminal is manufactured, a swollen portion is generated in the vicinity of a concave portion so that a width of the connecting terminal is made ununiform. As a result, in the case in which the connecting terminal is inserted into a housing of a connector, the connecting terminal is made unsteady or falls down laterally. In addition, in order to enhance a contact reliability of a movable contact with respect to a fine current or the like, it is effective to cause the movable contact to come in contact in a plurality of places in the sectional shapes shown in FIGS. 9(A), 10(B), 10(D), and 11(A) to 11(C). Referring to the method according to the comparative example, however, it is impossible to manufacture connecting terminals taking the sectional shapes.

(Structure of Connector)

The connector according to one or more embodiments of the present invention, particularly, a connector for connecting a flexible printed circuit board will be described below with reference to FIGS. 30 to 35.

FIGS. 30(A), 30(B) and 30(C) show states in which a connector 101 incorporating a connecting terminal for a connector is seen from an obliquely upper and forward part, an obliquely upper and rearward part and an obliquely lower part. Two types of connecting terminals for a connector are incorporated into the connector 101. One of the connector connecting terminals is the connector connecting terminal described above, for example, the connecting terminal 31 taking the shape shown in FIG. 5. The connector connecting terminal will be hereinafter referred to as a first connecting terminal A.

Figure 33:
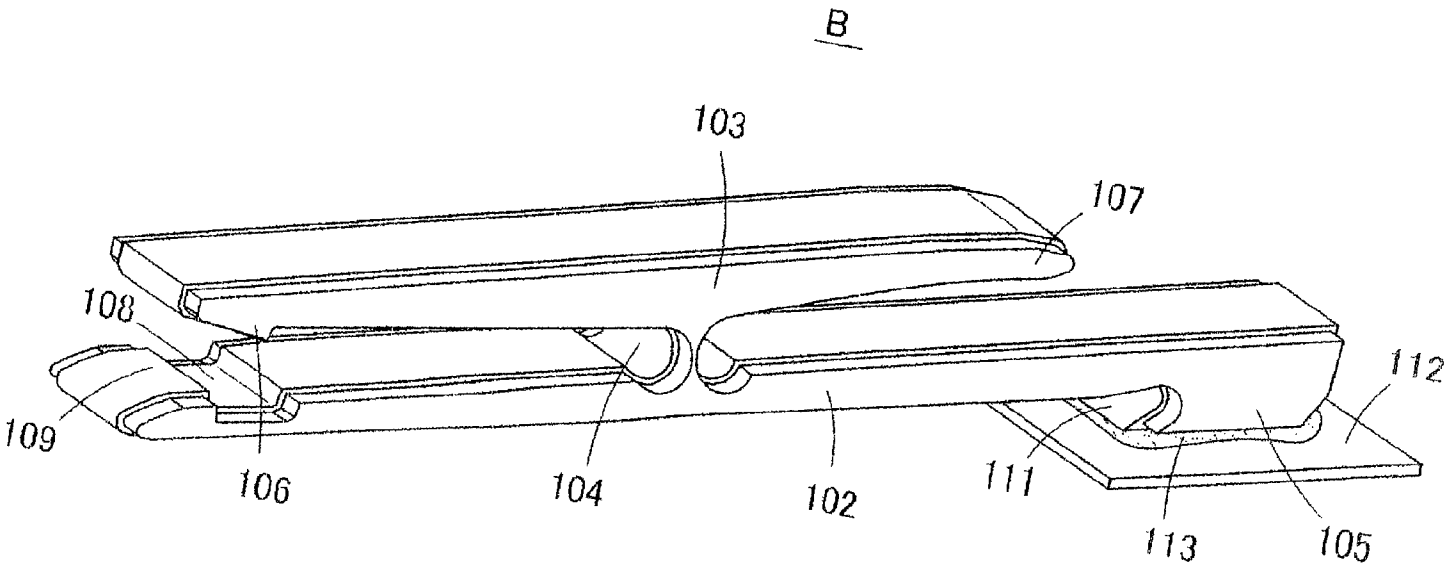
FIG. 33 is a perspective view showing a second connecting terminal.
Figure 34:
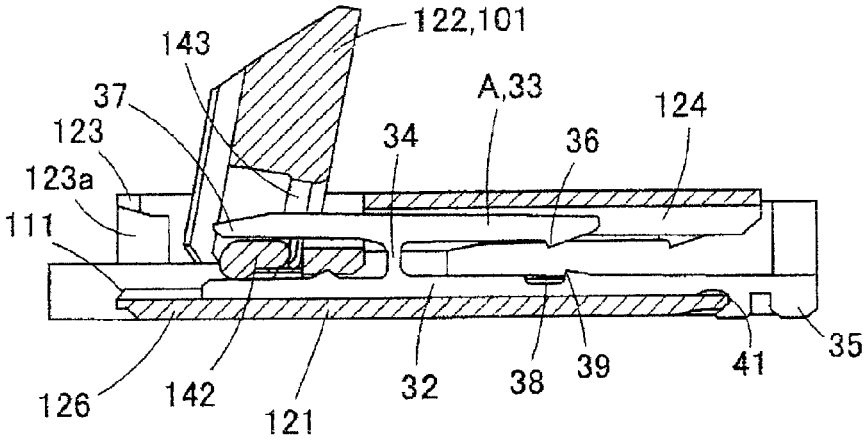
FIG. 34(A) is a sectional view showing a connector, illustrating a first connecting terminal incorporated in a housing.
FIG. 34(B) is a sectional view showing the connector, illustrating the second connecting terminal incorporated in the housing.
Figure 34:
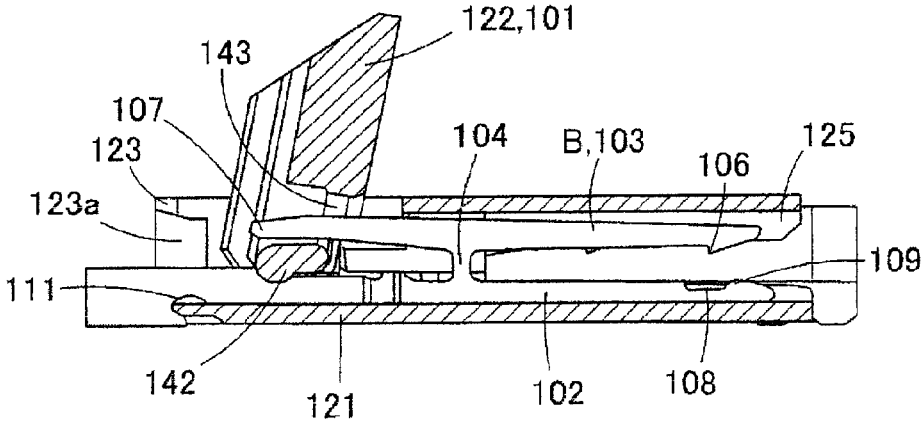
Figure 35:
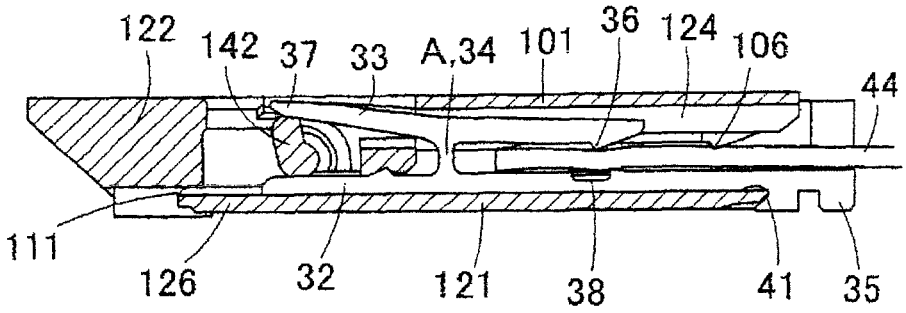
FIG. 35(A) is a sectional view showing the connector, illustrating the second connecting terminal mating with and holding the flexible printed circuit board.
FIG. 35(B) is a sectional view showing the connector, illustrating the first connecting terminal mating with and holding the flexible printed circuit board.
Figure 35:
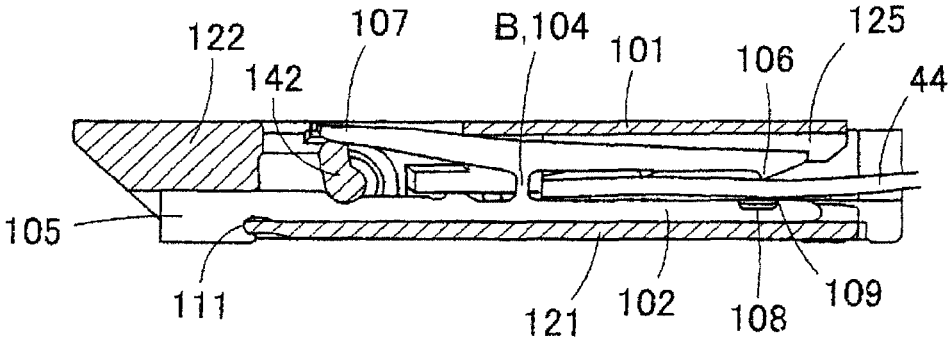

The other connector connecting terminal takes a shape shown in FIG. 33. The connector connecting terminal will be referred to as a second connecting terminal B. The second connecting terminal B has almost the same structure as that of the first connecting terminal A. In other words, the second connecting terminal B takes such a shape that a fixed piece 102 and a movable piece 103 are disposed in almost parallel with each other and an upper surface of an almost central portion of the fixed piece 102 and a lower surface of an almost central portion of the movable piece 103 are connected to each other through a coupling portion 104 which is almost perpendicular to both of the pieces 102 and 103. A fixing leg portion 105 (a fixed portion) for bonding the second connecting terminal B to an electrode pad 112 of a circuit board through a solder is protruded from a lower surface of a rear end of the fixed piece 102. The fixing leg portion 105 is exposed from a lower surface of a housing when the fixed piece 102 is inserted into a terminal inserting hole of the housing and the second connecting terminal B is thus incorporated into the housing. The fixing leg portion 105 is bonded to the electrode pad 112 of the circuit board through a solder 113 so that the connector 101 is mounted on the circuit board. A movable contact 106 taking a shape of a triangular projection is provided on a lower surface of a tip portion of the movable piece 103, and a rear end of the movable piece 103 serves as an operation receiving portion 107 for tilting the movable piece 103 through a cam (which will be described below). Moreover, an opposed portion of the fixed piece 102 to the movable contact 106 is provided with a trench portion 108 and a stopper portion 109 in order to enhance a force for holding a flexible circuit board.

A concave portion 40 is formed circularly along an outer peripheral surface of the second connecting terminal B at both side ends provided in contact with both side surfaces in the outer peripheral surface. Accordingly, the second connecting terminal B has four corner portions dented in an L shape in an optional section. In particular, each of the fixing leg portion 105 and the movable contact 106 has the concave portion 40 formed on both sides and a part between the concave portions 40 is protruded outward in a section.

Figure 30:
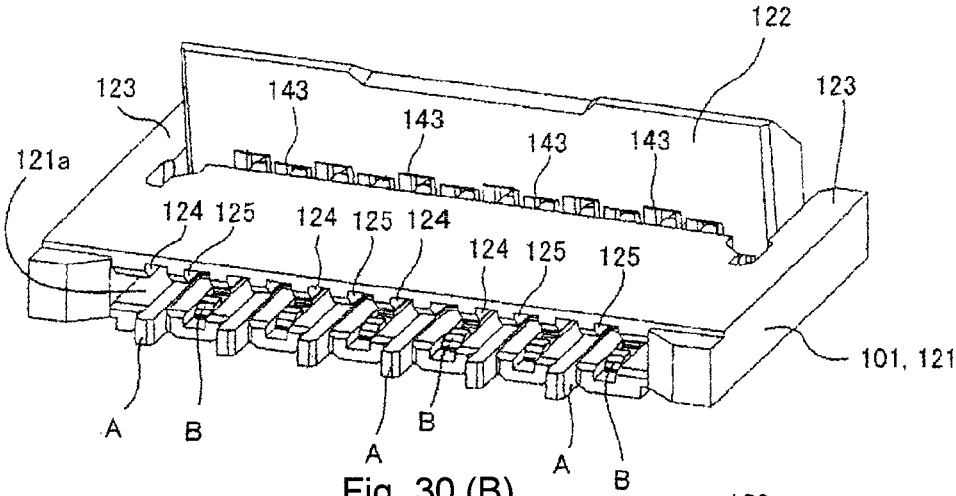
FIGS. 30(A), 30(B) and 30(C) are perspective views showing a connector incorporating a connecting terminal for a connector according to one or more embodiments of the present invention as seen at different angles.
Figure 30:
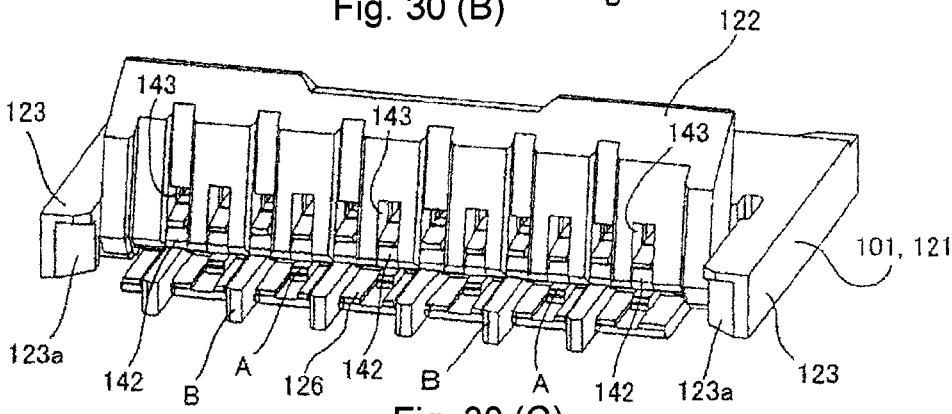
Figure 30:
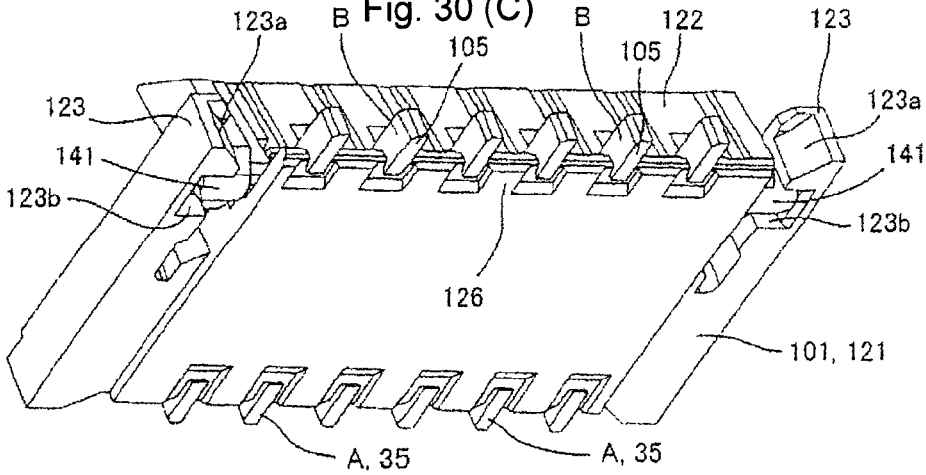

The connector 101 shown in FIG. 30 is roughly constituted by a base 121 (a housing), the first connecting terminal A, the second connecting terminal B and an operation lever 122.

As shown in FIG. 30, the base 121 has elastic arm portions 123 and 123 extended in parallel with each other at a back side from a single side edge portion on end faces at both sides thereof, respectively. In an inward surface of the elastic arm portion 123, a guiding taper surface 123*a* is formed on a tip edge portion and a bearing slit 123*b* is formed on an inner side thereof. Moreover, the base 121 has, on a front side thereof, an opening portion 121*a* capable of inserting a tip portion of a flexible printed circuit board 44 which will be described below, and furthermore, a first inserting hole 124 penetrating from a front face to a back face is arranged at a predetermined pitch. In addition, the base 121 has a guide plate 126 extended between the elastic arm portions 123 and 123 from a lower edge portion of the back face, and furthermore, has a second inserting hole 125 arranged in an adjacent position to the first inserting hole 124.

Figure 31:
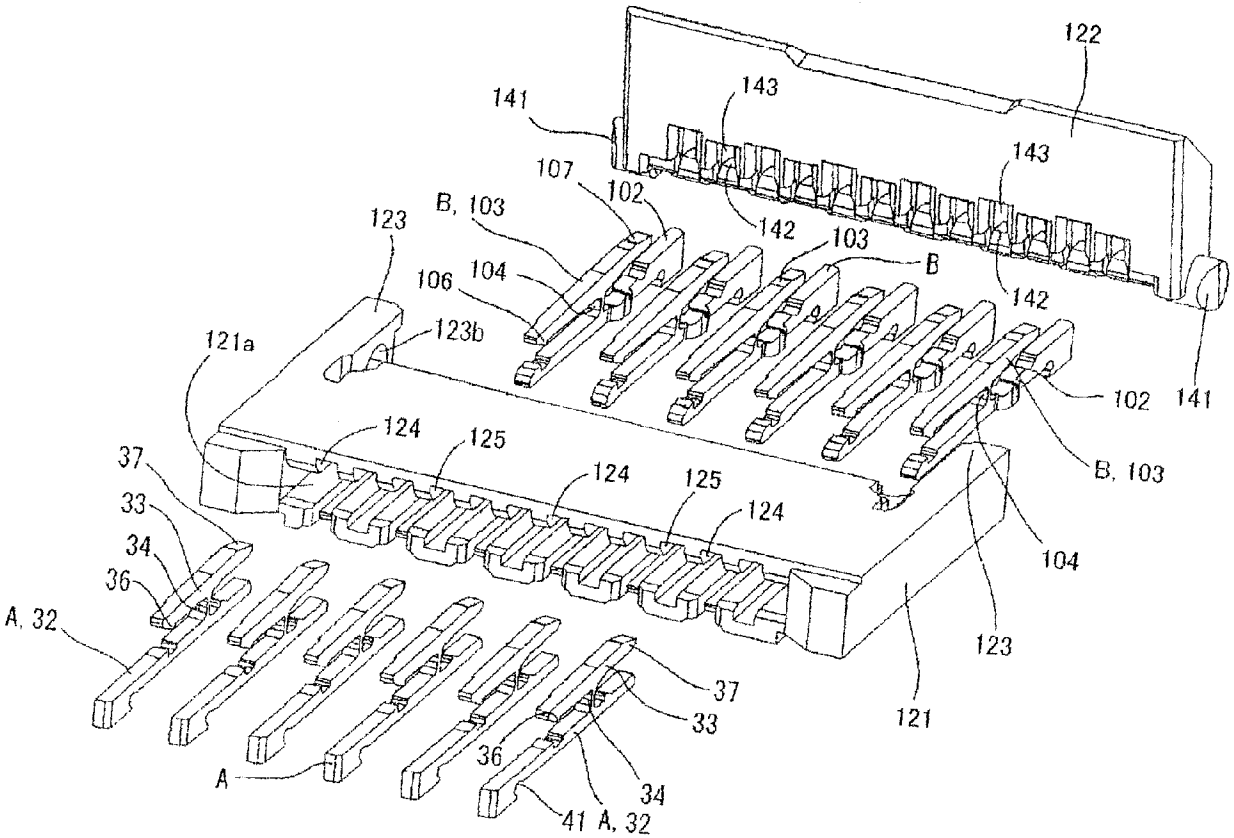
FIG. 31 is an exploded perspective view showing the connector illustrated in FIG. 30.

The operation lever 122 has rotating shaft portions 141 and 141 protruded concentrically from end faces at both sides as shown in FIG. 31. In the operation lever 122, moreover, a cam portion 142 for operating the operation receiving portions 37 and 107 of the first and second connecting terminals A and B is arranged at a predetermined pitch in a single side edge portion and a through hole 143 for inserting the operation receiving portions 37 and 107 therethrough is arranged in a corresponding position to the cam portion 142.

In the flexible printed circuit board 44 to be connected to the connector 101 according to the one or more embodiments of the present invention, contact portions 45*a* and 45*b* subjected to printed-wiring are alternately arranged in a staggered manner over an upper surface in a tip portion as shown in FIG. 32(A). A lead wire 46 is connected to the contact portions 45*a* and 45*b*, respectively.

The components are assembled in the following manner. First of all, a fixed piece 32 of the first connecting terminal A is inserted into the first inserting hole 124 from the opening portion 121*a* at the front side of the base 121. Consequently, an engaging click portion 41 provided in the first connecting terminal A is engaged with an edge portion of the base 121 and is thus positioned (see FIG. 34).

On the other hand, a fixed piece 102 of the second connecting terminal B is inserted into the second inserting hole 125 along a guide plate 126 of the base 121. Consequently, an engaging click portion 111 provided in the second connecting terminal B is engaged with an edge portion of the base 121 and is thus positioned.

As shown in FIGS. 34(A) and 34(B), subsequently, the operation receiving portions 37 and 107 of the first and second connecting terminals A and B are inserted into the through hole 143 of the operation lever 122 respectively, the operation lever 122 is slid along an upper surface of the fixed piece 102 of the second connecting terminal B, and the operation receiving portions 37 and 107 are pushed up by the cam portion 142 and are thus pushed in with an elastic deformation. Consequently, the cam portion 142 is fitted in the fixed piece 102 of the second connecting terminal B, and furthermore, the rotating shaft portion 141 is fitted in the bearing slit 123*b* of the base 121 so that the operation lever 122 is supported rotatably.

Figure 32:
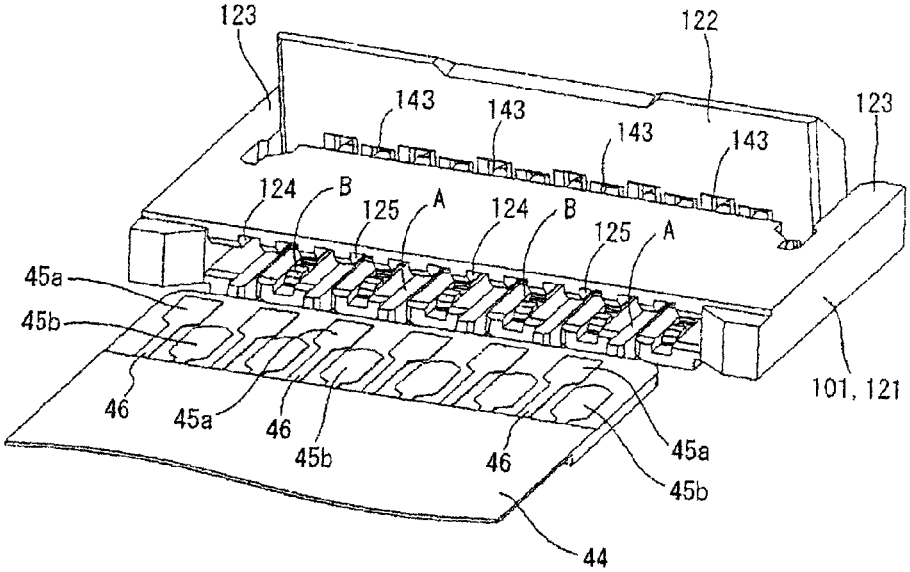
FIGS. 32(A) and 32(B) are perspective views showing states before and after a connection of a flexible printed circuit board to the connector illustrated in FIG. 30.
Figure 32:
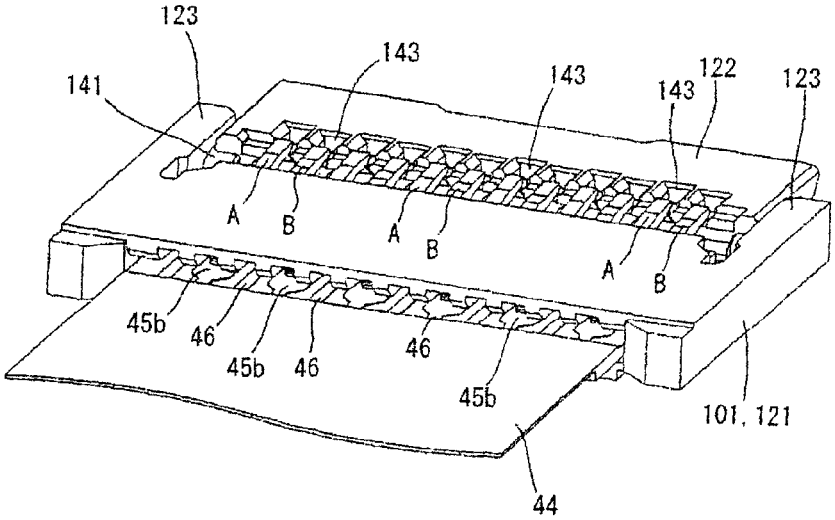

Next, a method of connecting and fixing the flexible printed circuit board 44 to the connector 101 will be described with reference to FIGS. 32, 35(A) and 35(B). As shown in FIG. 32, the tip portion of the flexible printed circuit board 44 is inserted into the opening portion 121*a* of the base 121 until it collides with an inner side surface of the base 121. When the operation lever 122 is rotated around a shaft center of the rotating shaft portion 141 and is thus pushed down, subsequently, the cam portion 142 pushes up the operation receiving portion 37 and 107 of the first and second connecting terminals A and B at the same time as shown in FIGS. 35(A) and 35(B). For this reason, the movable pieces 33 and 103 are tilted with the coupling portions 34 and 104 set to be fulcrums respectively, and the movable contacts 36 and 106 are conducted in pressure contact with the contact portions 45*a* and 45*b* provided in the tip portion of the flexible printed circuit board 44, respectively.

In the one or more embodiments of the present invention, the movable contacts 36 and 106 push down and curve the tip portion of the flexible printed circuit board 44, and furthermore, the movable contacts 36 and 106 and the stopper portions 39 and 109 enter the front and back surface of the flexible printed circuit board 44, thereby preventing a slip-out respectively. Therefore, it is possible to ensure a high contact reliability.

On the other hand, in the case in which the flexible printed circuit board 44 is removed from the connector 101, the operation lever 122 is rotated in a reverse direction to invert the cam portion 142, thereby releasing a bending moment for the operation receiving portions 37 and 107 of the first and second connecting terminals A and B. Subsequently, the connecting state of the moving contacts 36 and 106 to the contact portions 45*a* and 45*b* is released and the flexible printed circuit board 44 is then pulled out.

According to the one or more embodiments of the present invention, as shown in FIG. 32(A), the contact portions 45*a* and 45*b* in the flexible printed circuit board 44 are disposed in a staggered manner. Therefore, a mounting density can be increased still more and a size can easily be reduced, and furthermore, a contact reliability can be enhanced.

As shown in FIG. 30(B), moreover, both the fixing leg portion 35 of the first connecting terminal A and the fixing leg portion 105 of the second connecting terminal B are exposed from the lower surface of the base 121 (the housing). When the connector 101 is to be mounted on a circuit board, the fixing leg portions 35 and 105 can be mounted on the electrode pads 42 and 112 of the circuit board through solder bonding.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

DESCRIPTION OF SYMBOLS

31, 51-59 connecting terminal
A first connecting terminal
B second connecting terminal
32, 102 fixed piece
33, 103 movable piece
34, 104 coupling portion
35, 105 fixing leg portion
36, 106 movable contact
40 concave portion
42, 112 electrode pad
43, 113 solder
45 contact portion
61 electrode plate
62*a*-62*c*, 66, 71*a*-71*c*, 76*a*-76*c*, 81*a*-81*c* resist
64, 68*a*, 68*b*, 73, 78, 83 electroforming material

The invention claimed is:

1. A connecting terminal for a connector comprising:

a fixed portion configured to be connected to an electrode portion provided in a member for mounting the connector; and a contact configured to electrically come in contact with a contact portion of a connected portion to be connected to the connector, wherein at least one concave portion is provided continuously along a whole outer peripheral surface of the connector terminal, the concave portion passing through the fixed portion.

2. The connecting terminal for a connector according to claim 1, wherein the concave portion passes through the contact.

3. The connecting terminal for a connector according to claim 1, wherein the concave portion is provided along at least one of both side edges of the outer peripheral surface.

4. The connecting terminal for a connector according to claim 1, wherein a region protruded from the concave portion of the outer peripheral surface is divided into a plurality of regions through the concave portion.

5. A connector for incorporating a plurality of connecting terminals for a connector according to claim 1 into a base and operating the connecting terminals for a connector by an operation lever.

6. The connecting terminal for a connector according to claim 1, wherein the at least one concave portion is formed at a corner of the connecting terminal.

7. The connecting terminal for a connector according to claim 1, wherein the at least one concave portion is formed at a corner of the connecting terminal.

8. The connecting terminal for a connector according to claim 2, wherein the at least one concave portion is formed at a corner of the connecting terminal.

9. The connecting terminal for a connector according to claim 3, wherein the at least one concave portion is formed at a corner of the connecting terminal.

* * * * *